US009207590B2

(12) United States Patent
Momma et al.

(10) Patent No.: US 9,207,590 B2
(45) Date of Patent: Dec. 8, 2015

(54) FIXING APPARATUS AND IMAGE-FORMING APPARATUS

(71) Applicants: Susumu Momma, Kanagawa (JP); Koji Masuda, Kanagawa (JP); Hidemasa Suzuki, Kanagawa (JP)

(72) Inventors: Susumu Momma, Kanagawa (JP); Koji Masuda, Kanagawa (JP); Hidemasa Suzuki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/603,936

(22) Filed: Jan. 23, 2015

(65) Prior Publication Data

US 2015/0212465 A1 Jul. 30, 2015

(30) Foreign Application Priority Data

Jan. 28, 2014 (JP) ..... 2014-012898
Mar. 17, 2014 (JP) ..... 2014-053082

(51) Int. Cl.
*G03G 15/20* (2006.01)

(52) U.S. Cl.
CPC ..... *G03G 15/2017* (2013.01); *G03G 15/2039* (2013.01); *G03G 15/2053* (2013.01)

(58) Field of Classification Search
CPC ..... G03G 15/2017; G03G 15/2053
USPC ..... 399/67, 328, 329, 330
See application file for complete search history.

(56) References Cited

U.S. PATENT DOCUMENTS

2009/0238590 A1 9/2009 Masuda
2010/0008686 A1 1/2010 Masuda et al.
2010/0266302 A1 10/2010 Suzuki et al.
2011/0043810 A1 2/2011 Suzuki et al.
2011/0044713 A1 2/2011 Masuda et al.
(Continued)

FOREIGN PATENT DOCUMENTS

JP 05-113739 5/1993
JP 2006-251165 9/2006
(Continued)

OTHER PUBLICATIONS

U.S. Appl. No. 14/473,385, filed Aug. 29, 2014.
(Continued)

*Primary Examiner* — Benjamin Schmitt
(74) *Attorney, Agent, or Firm* — Oblon, McClelland, Maier & Neustadt, L.L.P.

(57) ABSTRACT

A fixing apparatus for fixing a toner image borne on a sheet-like recording medium onto the sheet-like recording medium, including: a fixing member relatively moving in a first direction with respect to the sheet-like recording medium, and having a surface in contact with the toner image during a fixing operation; a surface-information-detecting device for obtaining surface information of the fixing member; a surface-condition-changing device arranged to abut on and separate from the fixing member, and abrading the surface of the fixing member in contact with the fixing member; and a surface-condition-change controller for controlling an abutting and separating of the surface-condition-changing device with respect to the fixing member according to a detection result of the surface-information-detecting device. The surface-condition-change controller controls the surface-condition-changing device according to the detection result of the surface-information-detecting device with a criteria which varies before and after the surface-condition-changing device abrades the fixing device.

9 Claims, 12 Drawing Sheets

(56) References Cited

U.S. PATENT DOCUMENTS

| | | | | |
|---|---|---|---|---|
| 2011/0129266 | A1* | 6/2011 | Maruko et al. | 399/328 |
| 2012/0213539 | A1* | 8/2012 | Maruko | 399/67 |
| 2012/0268750 | A1 | 10/2012 | Masuda | |
| 2013/0058672 | A1* | 3/2013 | Takada et al. | 399/67 |
| 2013/0216267 | A1 | 8/2013 | Masuda et al. | |
| 2013/0243446 | A1 | 9/2013 | Masuda | |
| 2013/0243458 | A1 | 9/2013 | Suzuki et al. | |
| 2013/0251389 | A1 | 9/2013 | Suzuki et al. | |
| 2013/0308966 | A1 | 11/2013 | Masuda et al. | |
| 2014/0023391 | A1 | 1/2014 | Masuda | |
| 2014/0044460 | A1 | 2/2014 | Kudo et al. | |
| 2014/0071443 | A1 | 3/2014 | Suzuki et al. | |
| 2014/0219670 | A1 | 8/2014 | Masuda et al. | |
| 2014/0268180 | A1 | 9/2014 | Takaura et al. | |
| 2015/0078767 | A1 | 3/2015 | Momma et al. | |

FOREIGN PATENT DOCUMENTS

| | | | | |
|---|---|---|---|---|
| JP | 2007-034068 | | 2/2007 | |
| JP | 2010191275 A | * | 9/2010 | G03G 15/20 |
| JP | 2013-054108 | | 3/2013 | |

OTHER PUBLICATIONS

U.S. Appl. No. 14/477,168, filed Sep. 4, 2014.

* cited by examiner

ABUTTING STATE

SEPARATING STATE

FIXING APPARATUS AND IMAGE-FORMING APPARATUS

CROSS-REFERENCE TO RELATED APPLICATION

The present application is based on and claims priority from Japanese Patent Application No. 2014-012898, filed on Jan. 28, 2014, and Japanese Patent Application No. 2014-053082, filed on Mar. 17, 2014, the disclosures of which are hereby incorporated by reference herein in their entirety.

BACKGROUND

1. Field of the Invention

The present invention relates to a fixing apparatus and an image-forming apparatus, in particular, a fixing apparatus for fixing a toner image onto a sheet-like recording medium, and an image-forming apparatus including the fixing apparatus.

2. Description of the Related Art

An image-forming apparatus which forms an image on a sheet-like recording medium is heretofore known. Such an image-forming apparatus includes an image bearer, an exposure device which forms a latent image by irradiating the image bearer with light modulated according to image information, a developing device which generates a toner image by attaching toner to the latent image, a transfer device which transfers the toner image onto a recording medium, and a fixing apparatus which includes a fixing belt for fixing the toner image onto a sheet-like recording medium.

In such a type of image-forming apparatus, it is known that a linear scratch is generated on a sliding portion with the end portion of the sheet-like recording medium (printing paper, for example) in the fixing belt, and a so-called streak in a gloss surface (glossiness unevenness) is generated on the image formed (printed, or the like) on the sheet-like recording medium due to the linear scratch generated on the fixing belt (for example, refer to Japanese Patent No. 4632820).

SUMMARY

Herein, because the level of the scratch (depth of the scratch, for example) generated on the fixing belt as described above does not always stay constant, the level of the streak (contrasting density of the streak, for example) generated on the sheet-like recording medium does not always stay constant. Therefore, it has been desired to reduce a variation in image quality (such as printing quality) due to a variation of such a streak.

The present invention aims to provide a fixing apparatus for fixing a toner image disposed on a sheet-like recording medium onto the sheet-like recording medium, comprising a fixing member relatively moving in a first direction with respect to the sheet-like recording medium, and having a surface in contact with the toner image during a fixing operation, a surface-information-detecting device for obtaining surface information of the fixing member, a surface-condition-changing device arranged to abut on and separate from the fixing member, and abrading the surface of the fixing member in contact with the fixing member, and a surface-condition-change controller for controlling an abutting and separating of the surface-condition-changing device with respect to the fixing member according to a detection result of the surface-information-detecting device, wherein the surface-condition-change controller controls the surface-condition-changing device according to the detection result of the surface-information-detecting device with a criteria which varies before and after the surface-condition-changing device abrades the fixing device.

BRIEF DESCRIPTION OF THE DRAWINGS

The accompanying drawings are included to provide further understanding of the invention, and are incorporated in and constitute a part of this specification. The drawings illustrate Embodiments of the invention and, together with the specification, serve to explain the principle of the invention.

FIG. 7A is a graph corresponding to the fixing belt which has not been abraded by the surface-condition-changing roller. FIG. 7B is a graph corresponding to the fixing belt immediately after being abraded by the surface-condition-changing roller. FIG. 7C is a graph corresponding to the fixing belt after being abraded by the surface-condition-changing roller.

DETAILED DESCRIPTION OF THE PREFERRED EMBODIMENT

Figures 1A, 1B, 1C:
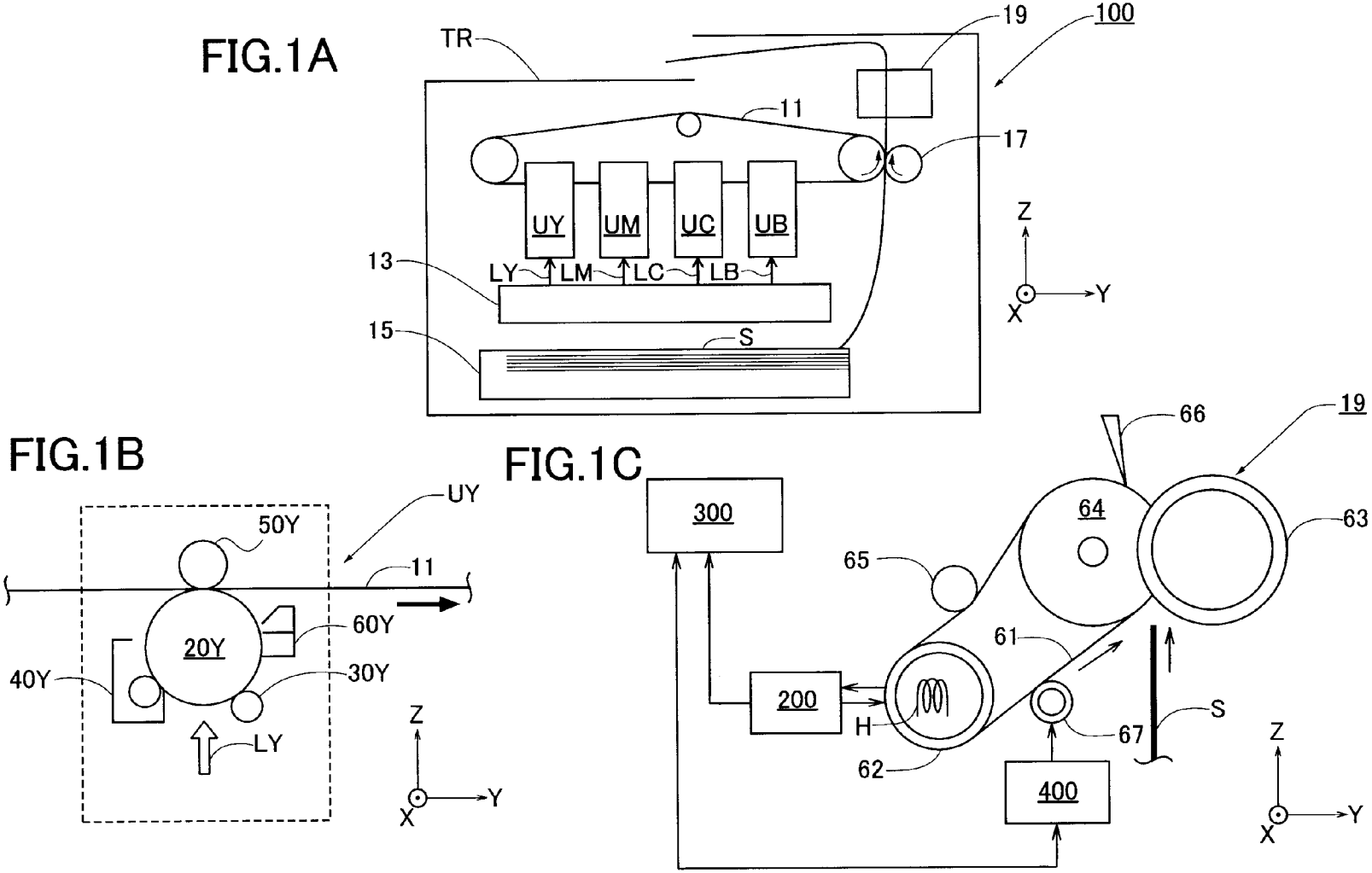
FIG. 1A schematically illustrates a configuration of a color printer according to Embodiment of the present invention.
FIG. 1B schematically illustrates a configuration of an image-forming unit included in the color printer shown in FIG. 1A.
FIG. 1C schematically illustrates a configuration of a fixing apparatus included in the color printer shown in FIG. 1A.

Hereinafter, an Embodiment of the present invention will be described with reference to FIG. 1A to FIG. 10. A color printer 100 is schematically illustrated in FIG. 1A as an example of an image-forming apparatus. The color printer 100 according to the present Embodiment is a so-called tandem-type printer. The color printer 100 includes a transfer belt 11, optical scanning device 13, cassette 15, secondary transfer roller 17, fixing apparatus 19, image-forming unit UY, UM, UC, and UB. As described later, the optical scanning device 13 scans and exposes a photoconductor drum which is included in each of the image-forming units UY to UB with each scanning-light LY to LB. Hereinafter, in the description the main-scanning direction of the scanning-light LY to LB is referred to as an X-axis direction, a vertical direction of the scanning-light LY to LB is referred to as a Z-axis direction, and a direction which is perpendicular to the X-axis direction and the Z-axis direction is referred to as a Y-axis direction.

The transfer belt 11 as an intermediate transcriptional body is wound around a plurality of (three in the present Embodiment) rollers. The transfer belt 11 is driven by a driving roller which is one of the three rollers, for example, and rotates in a counterclockwise direction. Herein, the lower side portion of the transfer belt is tensed flat so as to be in parallel with a predetermined two-dimensional plane surface (horizontal plane, for example).

The image-forming units UY, UM, UC, and UB are arranged in an area through which the above-described planarly tensed portion of the transfer belt 11 passes. Herein, reference characters Y, M, C, and B in the figures each represent yellow, magenta, cyan, and black, respectively. The image-forming unit UY generates a yellow image, the image-forming unit UM generates a magenta image, the image-forming unit UC generates a cyan image, and the image-forming unit UB generates a black image.

The optical scanning device 13 is arranged on the lower side (−Z side) of the image-forming units UY to UB as an image-writing device. The cassette 15 is arranged below the optical scanning device 13.

The above-described image-forming units UY to UB each have practically the same configurations; therefore, the image-forming unit UY will be described as a representative example with reference to FIG. 1B.

As shown in FIG. 1B, the image-forming unit UY includes a photoconductor drum 20Y as a photoconductive photoconductor. A charger 30Y as a contact-type charging roller, a developing unit 40Y as an image-writing portion using the scanning-light LY, a transfer roller 50Y, and a cleaning unit 60Y are arranged around the photoconductor drum 20Y. The transfer roller 50Y is arranged on the opposite side of the photoconductor drum 20Y through the transfer belt 11 so as to have contact with the rear surface of the transfer belt 11. Herein, a rectangle shown in FIG. 1B with a broken line represents the image-forming unit UY as a whole, although it does not always represent an actual configuration such as a casing.

The other image-forming units UM to UB shown in FIG. 1A include the same configuration as the image-forming unit UY. Hereinafter, although not shown in the figures, each element included in the image-forming units UM to UB, such as photoconductor drums 20M to 20B, chargers 30M to 30B, developing units 40M to 40B, transfer rollers 50M to 50B, and cleaning units 60M to 60B will be described. In addition, scanning-light toward the image-forming units UM to UB is described as scanning-light LM to LB (refer to FIG. 1A)

Next, a color image-printing process performed by the color printer 100 will be described simply.

Upon starting the color image generation process, the photoconductor drums 20Y to 20B and transfer belt 11 (refer to FIG. 1B, for each) start rotating. Each rotational direction of the photoconductor drums 20Y to 20B is in a clockwise direction, and a rotational direction of the transfer belt 11 is in a counterclockwise direction (refer to an arrow shown in FIG. 1B).

A photosensitive surface of each photoconductor drum 20Y to 20B is evenly charged by each of the chargers 30Y to 30B. The optical scanning device 13 (refer to FIG. 1A) writes an image to each photoconductor drum 20Y to 20B by a light-scanning process using the scanning-light LY to LB. Herein, various types of optical scanning devices which perform such an image-writing process are heretofore well known. Such a well-known optical scanning device is used appropriately as the optical scanning device 13.

The light-scanning process on the photoconductor drum 20Y is performed by using a laser beam having a light intensity which is modulated according to the yellow image as the scanning-light LY. Thereby, the yellow image is written in the photoconductor drum 20Y, and an electrostatic latent image corresponding to the yellow image is generated. The electrostatic latent image is a so-called negative latent image, and is visualized as a yellow toner image through reverse developing performed by the developing unit 40Y using yellow toner. The visualized yellow toner image is electrostatically primarily transferred onto the reverse side of the transfer belt 11 by the transfer roller 50Y.

The light-scanning process on the photoconductor drum 20M is performed by using a laser beam having light intensity which is modulated according to the magenta image as the scanning-light LM. Thereby, the magenta image is written in the photoconductor drum 20M, and an electrostatic latent image (negative latent image) corresponding to the magenta image is generated. The generated electrostatic latent image is visualized as a magenta toner image through reverse developing by the developing unit 40M using magenta toner.

The light-scanning process on the photoconductor drum 20C is performed by using a laser beam having light intensity which is modulated according to the cyan image as the scanning-light LC. Thereby, the cyan image is written in the photoconductor drum 20C, and an electrostatic latent image (negative latent image) corresponding to the cyan image is generated. The generated electrostatic latent image is visualized as a cyan toner image through reverse developing by the developing unit 40C using cyan toner.

The light-scanning process on the photoconductor drum 20B is performed by using a laser beam having light intensity which is modulated according to the black image as the scanning-light LB. Thereby, the black image is written in the photoconductor drum 20B, and an electrostatic latent image (negative latent image) corresponding to the black image is generated. The generated electrostatic latent image is visualized as a black toner image through reverse developing by the developing unit 40B using black toner.

The magenta toner image is electrostatically primarily transferred onto the transfer belt 11 by the transfer roller 50M. Herein, the magenta toner image overlaps with the yellow toner image which is transferred onto the transfer belt 11 ahead. Similarly, the cyan toner image is primarily transferred onto the transfer belt 11 by the transfer roller 50C so as to overlap with the yellow toner image and the magenta toner image which are overlapped and transferred onto the transfer belt 11 ahead. The black toner image is primarily transferred onto the transfer belt 11 so as to overlap with each toner image of yellow, magenta, and cyan on the transfer belt 11 by the transfer roller 50B.

Thereby, a color toner image is generated by overlapping each four-color toner image of yellow, magenta, cyan, and black on the transfer belt 11. Each photoconductor drum 20Y to 20B is cleaned up by cleaning units 60Y to 60B after the toner image is transferred so that the remaining toner or paper dust in each photoconductor drum 20Y to 20B is removed.

Transfer paper S is stacked and stored in the cassette 15. The transfer paper S is fed by a well-known sheet-feeding device (not shown), stops under the condition in which the tip portion of the transfer paper S is held by a timing roller (also referred to as a registration roller), and is sent into the secondary transfer part so as to match the timing of the transferring of the color toner image on the transfer belt 11. Herein, the secondary transfer part represents an abutment part of the transfer belt 11 and the secondary transfer roller 17 which contacts with and rotates corresponding to the transfer belt 11. The transfer paper S is sent into the secondary transfer part by the timing roller so as to match the timing of the arrival of the color toner image on the transfer belt 11 to the secondary transfer part.

Therefore, the color toner image is attached onto the transfer paper S, and electrostatically transferred (secondary transfer) onto the transfer paper S. The transfer paper S on which the color toner image is secondary transferred passes through the fixing apparatus 19. Then, the fixing apparatus 19 fixes the color toner image on the transfer paper S. After that, the transfer paper S is discharged on a tray TR arranged on the upper portion of the color printer 100.

The process of the color image printing which is performed by the color printer 100 is schematically described above. That is, the color printer 100 shown in FIG. 1A generates one or more toner images (yellow to black toner image) by the electrophotography process, transfers these toner images onto the transfer paper S, and fixes the toner image (color toner image) which is borne in the transfer paper S on the transfer paper S by the fixing apparatus 19.

Next, a configuration of the fixing apparatus 19 included in the color printer 100 shown in FIG. 1A will be described with reference to FIG. 1C. The fixing apparatus 19 is a so-called belt-fixing type fixing apparatus. The fixing portion of the fixing apparatus 19 includes a fixing belt 61 as a fixing member, as well as a heating roller 62, pressure roller 63, fixing roller 64, tension roller 65, peeling claw 66, and surface-condition-changing roller 67.

The fixing belt 61 includes a base material (basic layer) formed by nickel and polyimide or the like, and a mold-release layer formed by PFA (tetrafluoroethylene-perfluoroalkyl vinyl ether resin), PTFE (polytetrafluoroethylene) or the like. Furthermore, an elastic layer formed by silicon rubber or the like is included between the above base material and the mold-release layer. Accordingly, the surface of the fixing belt 61 is formed by resin which configures the mold-release layer, such as PFA and PTFE, and is set as an objective surface for detecting a scratch, as later described.

The fixing belt 61 is an endless belt, and is wound around a heating roller 62 and a fixing roller 64, and a predetermined tension (required tension) is applied to the fixing belt 61 by a tension roller 65. The heating roller 62 is for example, a hollow shaft roller formed by aluminum (or iron) or the like, and includes inside thereof a heat source H such as a halogen heater, or the like. The heating roller 62 heats the fixing belt 61 by the heat source H. Although not shown, a temperature sensor (thermopile or the like) for detecting the surface temperature of the fixing belt 61 is disposed on the surface of the fixing belt 61 so as not to have contact with the fixing belt 61. A contact-type temperature sensor (thermistor) can be used in place of the contactless temperature sensor.

The fixing roller 64 is configured by a metal cored bar on which an elastic layer of silicon rubber or the like is overlaid. The fixing roller 64 drives the fixing belt 61 so as to rotate in a counterclockwise direction. The pressure roller 63 is configured by a cored bar of aluminum or iron or the like, on which an elastic layer of the silicon rubber or the like is overlaid. The pressure roller 63 includes a surface layer formed by a mold-release layer of PFA, PTFE, or the like. The pressure roller 63 presses against the fixing belt 61 on a position facing the fixing roller 64. The fixing roller 64 is deformed by such pressure-contact, and thereby a nip portion is formed. The nip portion is arranged as the fixing portion for the color toner image which is electrostatically secondary-transferred onto the transfer paper S.

The tension roller 65 is configured by a metal cored bar on which an elastic layer of silicon rubber or the like is overlaid. A plurality of peeling claws 66 is arranged in an axis direction (direction vertical to the paper surface of the figures) of the fixing roller 64 so that a tip portion of the peeling claw abuts on the surface of the fixing belt 61.

The surface-condition-changing roller 67 is configured by a metal cored bar on which a surface layer having a predetermined roughness is overlaid. The surface layer has, for example, a concave-convex configuration in the order of several tens of μm. When the surface-condition-changing roller 67 contacts with the surface of the fixing belt 61 and rotates, the surface of the fixing belt 61 is abraded by rubbing between the fixing belt 61 and the surface-condition-changing roller 67. Thus a new surface is exposed. The surface-condition-changing roller 67 is accessible and separable to/from the fixing belt 61 as described later. Herein, a condition of the new surface is not always the same as the initial condition of the fixing belt 61 before being used (new product). The condition in which the linear scratch caused on the fixing belt 61 is undistinguished (for example, condition in which the linear scratch is inconspicuous among numbers of tiny scratches caused on the whole) is acceptable.

When the color toner image is fixed onto the transfer paper S in the fixing apparatus 19, the pressure roller 63 rotates in the clockwise direction at the same time as the fixing belt 61 is heated by the heat source H and rotates in the counterclockwise direction. Then, when the surface temperature of the fixing belt 61 approaches the predetermined temperature which permits fixing, the transfer paper S on which the color toner image is transferred is fed in the arrow direction in FIG. 1C and enters into the fixing part (nip portion). The color toner image receives heat from the fixing belt 61 on the transfer portion and also receives pressure by being pressed by the pressure roller 63 against the fixing belt 61. Thereby, the color toner image is fixed onto the transfer paper S.

In addition, the color printer 100 includes a not-shown cleaning device which cleans up the transfer belt 11 (refer to FIG. 1A). The cleaning device includes a cleaning brush which is arranged so as to face the portion in which the transfer belt 11 winds the roller in the left side of the image-forming unit UY in FIG. 1A, and to contact with the transfer belt 11, and a cleaning blade. The cleaning device cleans up the transfer belt 11 by scrubbing and removing foreign particles such as remaining toner and paper dust on the transfer belt 11, or the like. The cleaning device also includes a discharge unit in order to discharge and discard the remaining toner which is removed from the transfer belt 11.

Herein, a cutting section (edge portion) of the transfer paper S is sharp and sometimes a granular additive (such as calcium carbonate) may be exposed from the surface of the cutting section. Therefore, though the surface of the fixing belt 61 has no scratches at first in the fixing apparatus 19, the linear scratch or the like is generated due to the sliding movement with the transfer paper S with the repetition of the fixing operation. Furthermore, so-called offset (adherence of toner to the fixing belt 61) is generated on the surface of the fixing belt 61 with the repetition of the fixing operation in the fixing apparatus 19. The above-described linear scratch is also generated due to the contact with the peeling claw 66 or the like. The linear scratch may be easily generated in the case in which the sheet-like recording medium is a plastic sheet used for an overhead projector. Hereinafter, the existence and non-existence and degree of the offset caused on the surface of the fixing belt 61 as well as the condition and position of the scratch are referred to as surface information of the fixing belt.

The fixing apparatus 19 includes a surface-information-detecting device for detecting the surface information of the fixing belt 61. The surface-information-detecting device includes a reflective photosensor 200 which irradiates the surface of the fixing belt 61 with laser beam and receives reflective light of the laser beam, and a surface-information-detecting portion 300 which detects the surface information of the fixing belt 61 according to the detection result of the reflective photosensor 200.

The reflective photosensor 200 is arranged to face a portion on the fixing belt 61 where the fixing belt 61 is wound around the heating roller 62. The reflective photosensor 200 includes a light-emitting portion which emits a plurality of laser beam in a direction which is parallel to the width direction of the fixing belt 61 toward the surface of the fixing belt 61, and a sensor portion which receives reflective light of the laser beam from the fixing belt 61 (the emitting portion and sensor portion are not shown in FIG. 1C). The configuration and operation of the reflective photosensor 200 will be described in detail later. Because the width direction of the fixing belt 61 is in parallel with the main scanning direction in image-writing using the scanning light LY to LB (refer to FIG. 1A), the width direction of the fixing belt 61 is referred to as the main-scanning direction.

The surface-information-detecting portion 300 is arranged inside the color printer 100 (refer to FIG. 1A). The surface-information-detecting portion 300 is connected to the reflective photosensor 200 so as to detect the surface condition of the fixing belt 61 as the surface information upon receiving a sensing signal from the reflective photosensor 200. In addition, the surface-information-detecting portion 300 also includes a function to control the performance of the reflective photosensor 200.

Figure 2:
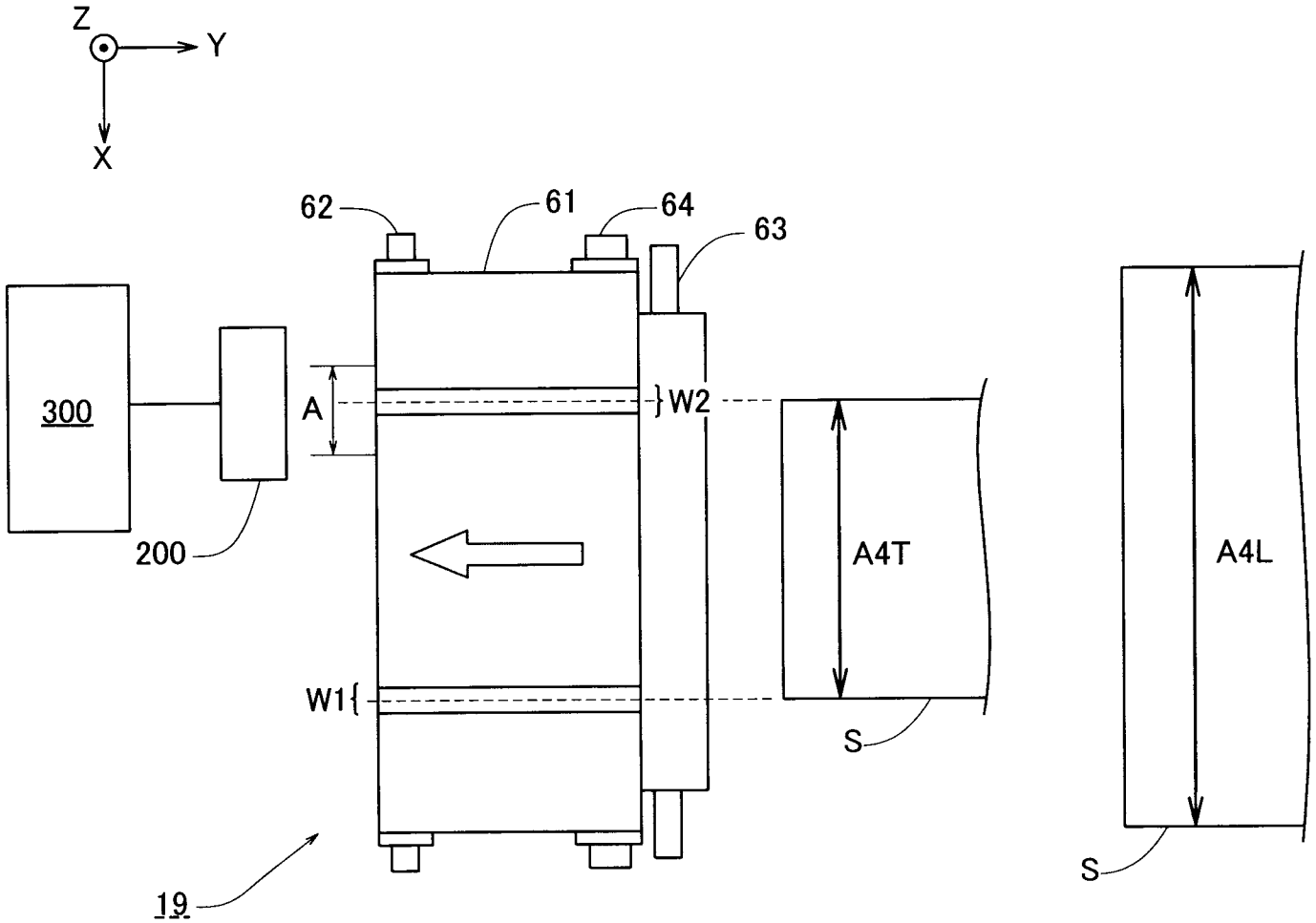
FIG. 2 illustrates a relationship between the fixing apparatus and transfer paper.

FIG. 2 schematically illustrates the fixing apparatus 19, which includes the reflective photosensor 200. For example, A-4 size transfer paper can be fed to the fixing apparatus 19 in the longitudinal direction or in the short side direction of the paper by the color printer 100 (refer to FIG. 1A) according to the present Embodiment. In FIG. 2, the reference A4T represents the paper width when the A-4 size transfer paper S is fed in the longitudinal direction of the paper, and the reference A4L represents the paper width when the A-4 size transfer paper S is fed in the short side direction of the paper.

The dimension of the fixing belt 61 in the width direction (X axis direction) is set so as to be approximately the same as the paper width A4L. Accordingly, the linear scratch caused on an end portion of the fixing belt 61 in the longitudinal direction has no problem when the A-4 size transfer paper S is fed in the short side direction. In contrast, because the paper width A4T is shorter than the dimension of the fixing belt 61 in the width direction, the above-described problems of the linear scratch may occur when the A-4 size transfer paper S is fed in the longitudinal direction.

When a plurality of A-4 size transfer paper S is fed in the longitudinal direction of the paper, it cannot perfectly match each position of the transfer paper S in relation to the direction (up and down direction in the figures) which is in parallel to the width direction of the fixing belt 61. That is, the positions of both end portions of the transfer paper S on the fixing belt 61 slightly move to the width direction of the fixing belt 61. In addition, so-called belt deflection may occur in the fixing belt 61 itself and the positions of both end portions of each transfer paper S on the fixing belt 61 also slightly move. Furthermore, because the generation of the linear scratch is concentrated in a narrow area when the moving range of the position where the transfer paper S contacts with the fixing belt 61 is narrow, the position of the transfer paper S in relation to the fixing belt 61 may be purposely changed per each transfer paper S upon feeding a plurality of transfer paper S.

Thus, the fixing belt 61 and both end portions of the vertically-long transfer paper S in the paper width direction contact with each other within an area W1 and W2 (hereinafter, referred to as contact areas W1 and W2) which have a predetermined width in relation to the direction in parallel with the width direction of the fixing belt 61. The dimensions of the above contact areas W1 and W2 in the present Embodiment is, for example, about 10 mm.

Considering such contact areas W1 and W2, when the A4-size transfer paper S is fed in the longitudinal direction of the paper, it is required to set the dimension of a detection area A to be larger than that of the contact areas W1 and W2 in the width direction when the surface condition (existence and non-existence of linear scratch, position, or the like) on the fixing belt 61 is detected.

Therefore, the detection area A for detecting the surface information of the fixing belt 61 by the reflective photosensor 200 in the fixing apparatus 19 is set to be larger than the contact area W2 between the contact areas W1 and W2. It is appropriate to set the detection area A to have a dimension of about 15 mm since the width dimension of the scratch is from about several hundreds of μm to about several mm and the movable range of the position of the scratch is about 10 mm in the present Embodiment. Herein, the detection area A (that is, reflective photosensor 200) is not arranged in a position corresponding to the contact area W1 in the present Embodiment. This is because the linear scratch on the fixing belt 61 may be generated approximately the same on both contact area W1 and contact area W2, and it is practically sufficient as long as the surface information of the fixing belt 61 is obtained on at least one of the contact area. Of course, the detection area A can be set corresponding to both contact area W1 and contact area W2. Furthermore, the dimension of the detection area A can be set so as to cover the width of the fixing belt 61 entirely.

The reflective photosensor 200 emits a plurality of detection light at a predetermined interval toward a direction which is in parallel with the width direction (X-axis direction) of the fixing belt 61. The area being irradiated by the detection light configures the detection area A. The relative positional relationship between the reflective photosensor 200 and the end portion of transfer paper S in the paper width direction can be made in a comparatively rough arrangement because the reflective photosensor 200 can form the long detection area A.

The surface-information-detecting portion 300 quantifies (process of quantification will be described later) the position of the linear scratch generated by the end portion of the transfer paper S in the width direction and the level of scratch as the surface information of the fixing belt 61 according to the detection signal from the reflective photosensor 200. The level of the scratch herein represents an extent of the scratch, that is, a depth of the scratch (difference in the surface roughness between the scratch portion and the portion without scratches).

Next, an example of a configuration of the reflective photosensor (reflective-type optical detecting device) 200 will be described with reference to FIG. 3A to FIG. 3D.

As shown in FIG. 3A to FIG. 3D, the reflective photosensor 200 includes a substrate 201, lateral plates 202 and 203, lateral plates 205 and 206 (not shown in FIG. 3A, refer to FIG. 3B, for each), and a lens element 204.

Figure 3A:
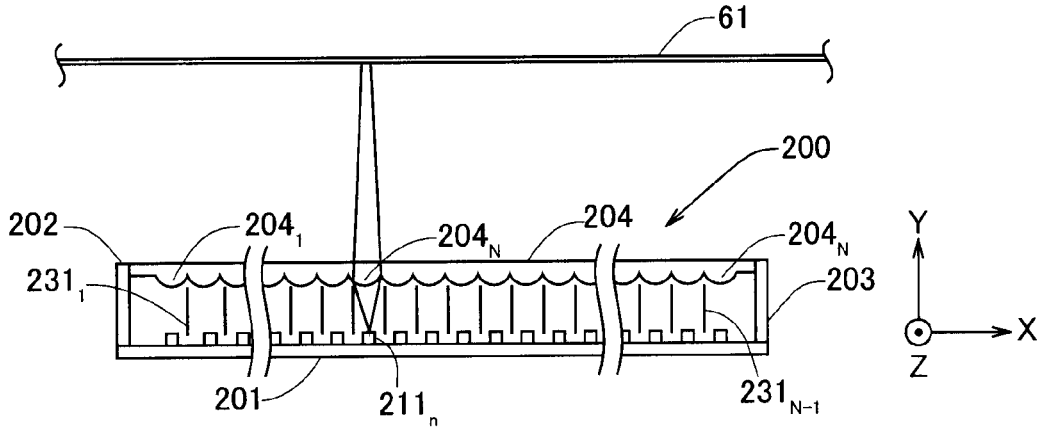
FIG. 3A illustrates a sectional view of a configuration of a reflective photosensor on an emission side.
Figure 3B:
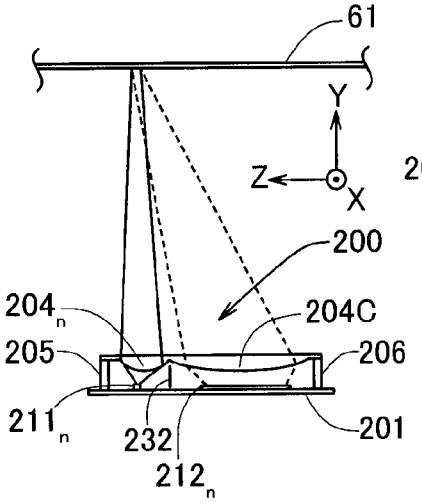
FIG. 3B is an explanatory view illustrating an arrangement between a lens element, LED, and PD included in the reflective photosensor.
Figure 3C:
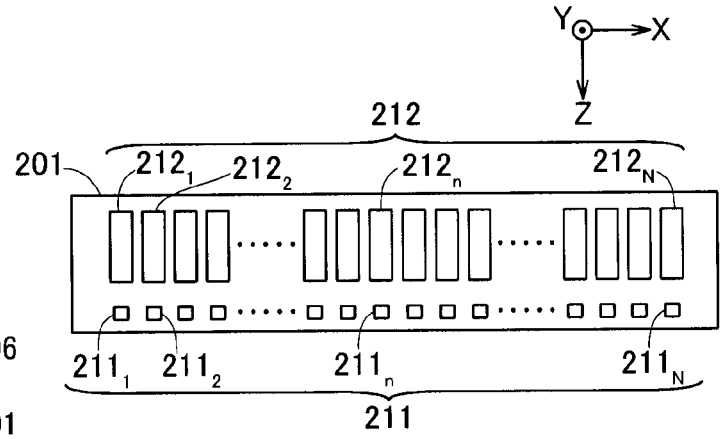
FIG. 3C is a plan view illustrating a substrate included in the reflective photosensor.

As shown in FIG. 3C, a plurality of LEDs (Light Emitting Diode) 211, and a plurality of photo diode 212 (hereinafter, referred to as PD 212) are arranged on the substrate 201 to have a predetermined interval in the X-axis direction. The number of LED 211 to be arranged is determined according to a design condition. Generally, several tens to several hundreds of the LEDs 211 can be arranged. The number of PD 212 is similar to the number of LED 211, and the arrangement pitch of the PD 212 is similar to that of the LED 211.

To make the description simple, each LED 211 is assigned a number individually from left side of FIG. 3C in order. The $n^{th}$ one from the left side is represented as LED $\mathbf{211}_n$. When the total number of LED 211 is supposed to be N, the total LEDs 211 are therefore arranged as LED $\mathbf{211}_1$, $\mathbf{211}_2$ . . . , $\mathbf{211}_n$ . . . , $\mathbf{211}_N$, in order. Similarly, the PD 212 is assigned a number from left side of FIG. 3C one by one in order, and $n^{th}$ one from the left side is represented as PD $\mathbf{212}_n$. The total number of PD 212 is N and the arrangement of the total PD 212 is therefore represented as PD $\mathbf{212}_1$, $\mathbf{212}_2$ . . . , $\mathbf{212}_n$ . . . $\mathbf{212}_N$, in order.

LED $\mathbf{211}_n$ (n=1 to N) and PD $\mathbf{212}_n$ (n=1 to N) correspond to one for one. As shown in FIG. 3C, LED $\mathbf{211}_n$ and PD $\mathbf{212}_n$ which correspond to each other are arranged so as to be in the parallel position in the X-axis direction.

Figure 3D:
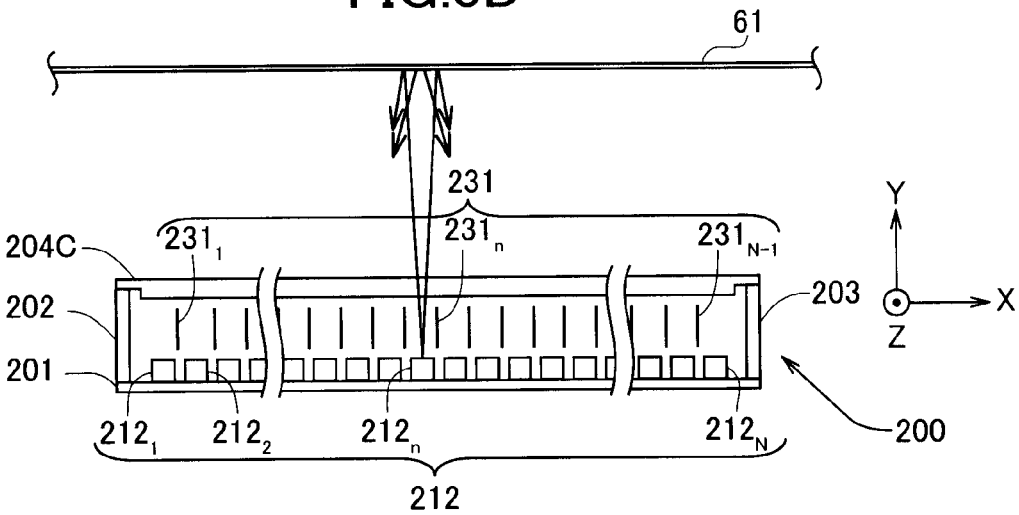
FIG. 3D is a sectional view illustrating a configuration of the reflective photosensor on a light-receiving side.

The lens element 204 is configured by two areas which include an area for an irradiation lens array in which each irradiation lens $\mathbf{204}_n$ (n=1 to N) is arranged in an array as shown in FIG. 3A, and an area for a light-receiving lens 204C as shown in FIG. 3D.

The number of the irradiation lens $\mathbf{204}_n$ is the same as that of the LED 211 (N). Each irradiation lens $\mathbf{204}_n$ is arranged on the direction Y side of the LED 211 so that the LED $\mathbf{211}_n$ corresponds to the irradiation lens $\mathbf{204}_n$ one by one for each. The irradiation lenses $\mathbf{204}_n$ are arranged in the X-axis direction at the predetermined intervals. The light-receiving lens 204C is a single cylindrical lens including a positive power only in the Z-axis direction as shown in FIG. 3D, and is arranged on the direction Y side of the PD $\mathbf{212}_1$ to $\mathbf{212}_N$. The irradiation lens array portion in which the irradiation lens $\mathbf{204}_n$ (n=1 to N) is formed and the portion in which the light-receiving lens 204C is formed can be combined by, for example, resin molding using a synthetic resin material.

The reflective photosensor 200 includes a light-shielding wall $\mathbf{231}_n$ (n=1 to N−1) in order to prevent flare light between the groups adjacent to each other in the group of the LED $\mathbf{211}_n$ and irradiation lens $\mathbf{204}_n$ as shown in FIG. 3A and FIG. 3D. In addition, the reflective photosensor 200 includes a light-shielding wall 232 in order to prevent flare light between the LED $\mathbf{211}_n$ array and the PD $\mathbf{212}_n$ array as shown in FIG. 3B.

In addition, the lateral plates 202 and 203 (refer to FIG. 3A) and lateral plates 205 and 206 (refer to FIG. 3B) are combined so as to configure a case for reflective photosensor 200. The case (lateral plates 202, 203, 205, and 206), light-shielding wall $\mathbf{231}_n$ (refer to FIG. 3A), light-shielding wall 232 (refer to FIG. 3B), and lens element 204 can be combined by resin molding using synthetic resin material, for example.

As shown in FIG. 3A, when the LED $\mathbf{211}_n$ is turned on, a bundle of irradiated divergent light is concentrated by the irradiation lens $\mathbf{204}_n$ which corresponds to the LED $\mathbf{211}_n$ and irradiates the surface of the fixing belt 61 in the reflective photosensor 200. As shown in FIG. 3B, reflective light from the portion irradiated by the bundle of light from the LED $\mathbf{211}_n$ (referred to as light spot) on the surface of fixing belt 61 is concentrated by the light receiving lens 204C only in the Z-axis direction, and enters into the PD $\mathbf{212}_n$.

The fixing apparatus 19 includes a surface-condition-change controller 400 so as to control the performance of the surface-condition-changing roller 67 as shown in FIG. 1C. The surface-condition-change controller 400 is arranged inside the color printer 100 (refer to FIG. 1A). The surface-condition-change controller 400 is connected to the surface-condition-changing roller 67 so as to control the performance of the surface-condition-changing roller 67 according to the detection result from the surface-information-detecting portion 300 (detection signal from the reflective photosensor 200). Such a control process will be described later.

The surface-condition-changing roller 67 performs the abutting, separating and sliding operation with regard to the fixing belt 61 by a driver which is not shown in FIG. 1C. The not-shown driver and the surface-condition-changing roller 67 configure the surface-condition-changing device. The driving means is controlled by the surface-condition-change controller 400.

Figure 4:
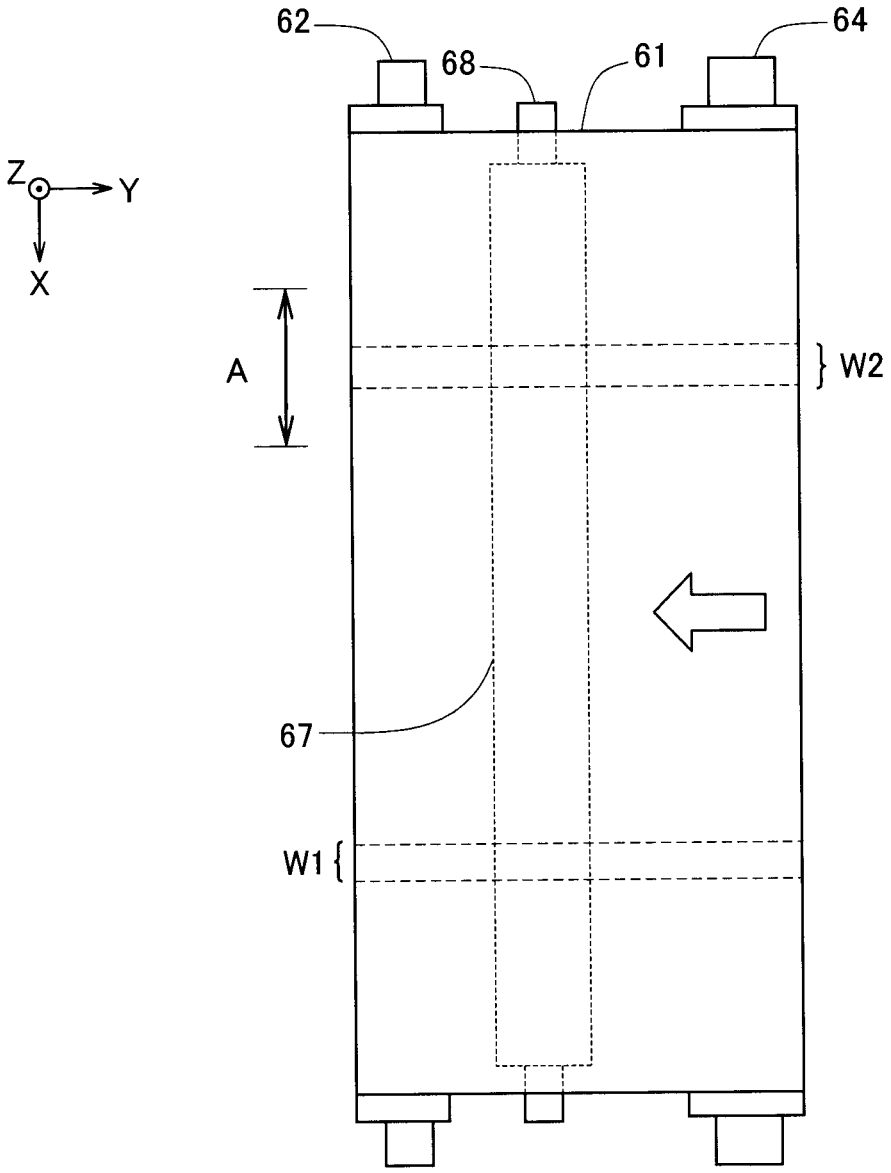
FIG. 4 illustrates an arrangement of a surface-condition-changing roller.

As shown in FIG. 4, the surface-condition-changing roller 67 is disposed on a rotational axis 68. The length of the surface-condition-changing roller 67 in the parallel direction to the rotational axis 68 (direction conforming to the width direction of fixing belt 61) is set so as to change the surface condition of approximately the whole area of the fixing belt 61 in the width direction. Thereby, not only that the surface of the fixing belt 61 can be refined by abrading the linear scratch generated on the fixing belt 61 due to the sliding friction between the both end portions of the transfer paper S (not shown in FIG. 4, refer to FIG. 2) in the paper width direction, but the surface of the fixing belt 61 can be uniformly reformed over the approximately total area of the fixing belt 61 in the width direction. The surface condition can be similarly refined effectively from the scratch generated by a stripping claw or the temperature sensor, or from the offset.

It is appropriate that the surface-condition-changing roller 67 be arranged so as to achieve at least an object such that the surface condition of the portion on which the linear scratch is generated in the fixing belt 61 can be changed. For example, a pair of surface-condition-changing rollers (not shown) which has a narrower width (short length in the direction of rotational axis 68) than that of the surface-condition-changing roller 67 shown in FIG. 4 can be provided on a position corresponding to the contact areas W1 and W2. In this case, it is appropriate that each width diameter of the not-shown rollers be slightly shorter than the detection area A and slightly longer than the contact areas W1 and W2.

Figure 5A:
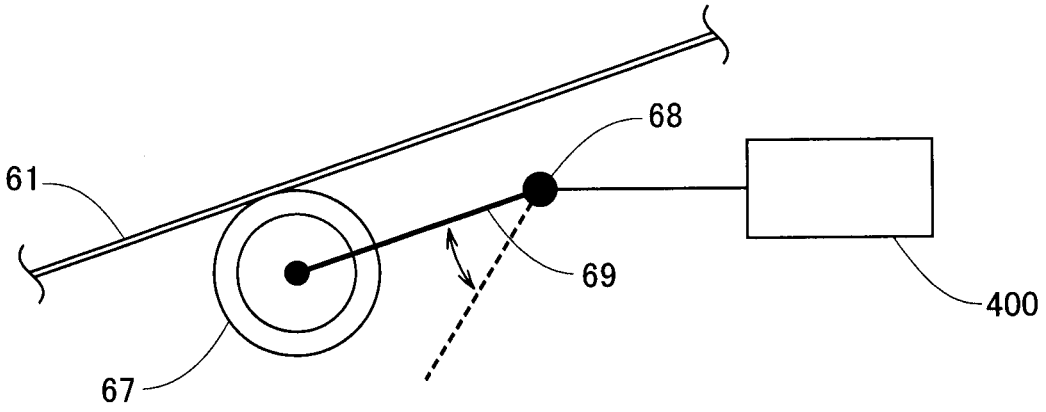
FIG. 5A and FIG. 5B illustrate each condition in which the surface-condition-changing roller abuts on the surface of the fixing belt, and in which the surface-condition-changing roller separates from the surface of the fixing belt.
Figure 5B:
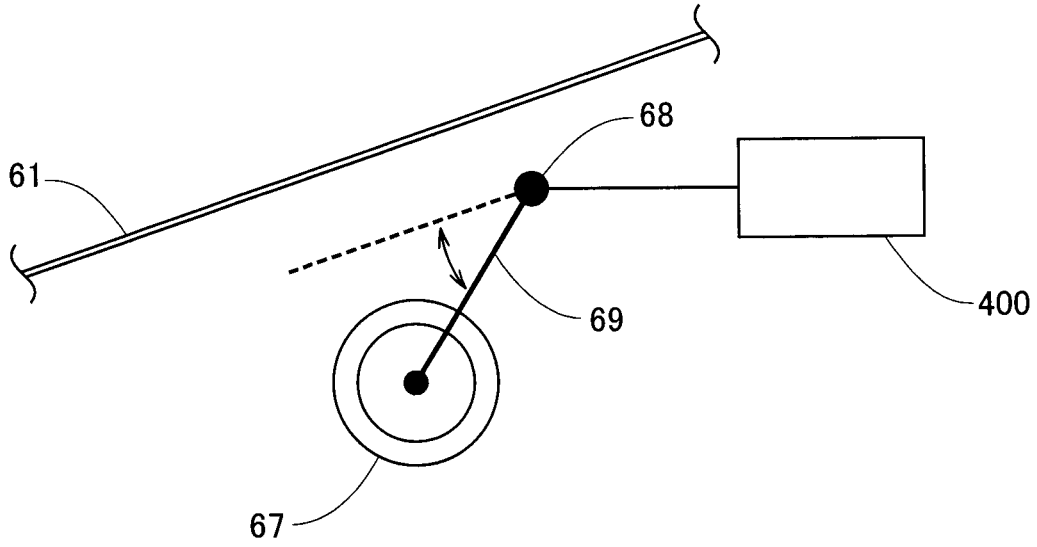

As schematically shown in FIG. 5A to FIG. 5B, the surface-condition-changing roller 67 is supported by a rod 69. The rod 69 is connected to the rotational axis 68 and these rod 69 and rotational axis 68 are controlled by the surface-condition-change controller 400. FIG. 5A illustrates the state of the surface-condition-changing roller 67 in contact with the surface of the fixing belt 61. FIG. 5B illustrates the state of the surface-condition-changing roller 67 being separated from the fixing belt 61. Thus, the surface-condition-changing roller 67 is connectable and separable to/from the fixing belt 61.

A control portion of the reflective photosensor 200 and surface-condition-changing roller 67 in the surface-information-detecting portion 300 and surface-condition-change controller 400 may be configured as a microcomputer or CPU. The control portion can be stored in one computer as a control program.

Next, a detecting operation of the surface condition of the fixing belt 61 by the surface-information-detecting portion 300 using the reflective photosensor 200 will be described with reference to the flow chart shown in FIG. 6.

In the present Embodiment, the surface-information-detecting portion 300 repeats the switching on and off operation on the LED $\mathbf{211}_1$ to LED $\mathbf{211}_N$ in FIG. 3A one by one in order, that is, the surface-information-detecting portion 300 operates so-called sequentially lightning. Therefore, the surface-information-detecting portion 300 inputs n=1 in step S01, and turns on the LED $\mathbf{211}_n$ (LED $\mathbf{211}_1$) in the following step S03, then the process proceeds to step S05.

The surface-information-detecting portion 300 selects the PD 212 which receives the reflective light from the fixing belt 61 upon synchronizing with the lighting of the $n^{th}$ LED $\mathbf{211}_n$ in step S05. Herein, because the reflective light from the fixing belt 61 is not a specular reflection and it spreads toward the X-axis direction, and also, the reflective light upon turning on the LED $\mathbf{211}_n$ is received by the corresponding PD $\mathbf{212}_n$ and the other PD 212 which is adjacent to the PD $\mathbf{212}_n$. To make the description simple, the number of the PD 212 for receiving light is an uneven number and it is supposed to be (2m+1) when m is an integral number in the present Embodiment. That is, the reflective light upon turning on the LED $\mathbf{211}_n$ is received by the corresponding PD $\mathbf{212}_n$ and the 2m+1 PDs which are arranged on both sides of the PD $\mathbf{212}_n$. For example, supposing m=2, the PD which receives the reflective light is five including PD $\mathbf{212}_{n-2}$, PD $\mathbf{212}_{n-1}$, PD $\mathbf{212}_n$ (corresponds to LED $\mathbf{211}_n$), PD $\mathbf{212}_{n+1}$, and PD $\mathbf{212}_{n+2}$. However, the number of the PD for receiving light is not five but three of PD $\mathbf{212}_1$, PD $\mathbf{212}_2$, and PD $\mathbf{212}_3$ when n=1 and the LED $\mathbf{211}_1$ is turned on, even if m=2 herein. Similarly, the number of PD for receiving light is not five but three of PD $\mathbf{212}_{N-2}$, PD $\mathbf{212}_{N-1}$, and PD $\mathbf{212}_N$ provided that n=N.

After the predetermined time which is sufficient for receiving reflective light from the fixing belt 61 has passed, the surface-information-detecting portion 300 turns off the LED $\mathbf{211}_n$ (LED $\mathbf{211}_1$, herein) in the following step S07. When turning on/off operation of the LED 211 is performed, a plurality of PD 212 which receives the reflective light performs photoelectric conversion of the amount of received light. The photoelectrically converted signal becomes a detection signal after being amplified. Each detection signal of PD 212 is sent to the surface-information-detecting portion 300 in each detection operation. The surface-information-detecting portion 300 receives the signal in step S09 and the process goes to step S11.

In step S11, the surface-information-detecting portion 300 detects whether the sequential lighting of a plurality of LEDs 211 is finished or not. That is, the surface-information-detecting portion 300 determines that it does not receive the detection signals from all of the PD $\mathbf{212}_1$ to PD $\mathbf{212}_n$ when n<N, and increments n in the following step S13, then the process returns to step S03. Thereafter, when n=N after the repetition of the sequential lightning by all LEDs and the LED $\mathbf{211}_N$ is turned on and off, the sequential lighting is finished because such a process is determined as one cycle. When n becomes equal to N (n=N) in step S11, the process operated by the surface-information-detecting portion 300 goes to step S15.

Herein, in the present Embodiment, in order to increase the accuracy of detection by each PD $\mathbf{212}_1$ to 212N, several cycles of the above-described sequential lightning of LED 211 (step S1 to step S 13) are performed and for example, a process to average the detection result in each cycle can be performed as well. In step S15, the surface-information-detecting portion 300 determines whether it should repeat the sequential lightning of LED $\mathbf{211}_1$ to $\mathbf{211}_N$ or not. When the surface-information-detecting portion 300 determines to perform the sequential lighting, the process returns to step S01 and the surface-information-detecting portion 300 repeats the succeeding process. When the surface-information-detecting portion 300 determines not to repeat the sequential lighting, the process is terminated. Herein, it is not necessary to turn on or off all N of LEDs 211, but the arbitral N' (≤N) therein can be used for lightning on/off. For example, For example, it is not necessarily to use N of LEDs $\mathbf{211}_1$ to $\mathbf{211}_N$ for the sequential lightning on/off, but it can be configured to light on and off the LED $\mathbf{211}_3$ to LED $\mathbf{211}_{N-2}$, thus the N−4 LEDs excepting each two LED on both ends.

In addition, when the detection signal from the PD 212 is sent to the surface-information-detecting portion 300, the surface-information-detecting portion 300 obtains the surface information of the fixing belt 61 in accordance with the following process.

When the surface-information-detecting portion 300 receives the detection signal (the number of detection signal is 2m+1 with respect to the turning on/off operation of a single LED, in principle) from each PD ($\mathbf{212}_1$ to $\mathbf{212}_N$), the surface-information-detecting portion 300 calculates the sum of the total detection signals (2m+1) at each time it receives the detection signal, and determines the calculation result herein as the detection result $R_n$ (n=1 to N). Thereby, the surface-information-detecting portion 300 can obtain the detection result $R_n$ regarding a plurality of points (light spot) on the fixing belt 61 which corresponds to a plurality of LEDs 211 arranged on the fixing belt 61 in the width direction of the fixing belt 61 so as to have predetermined intervals. Herein, the detection result $R_n$ is not the value detected by PD but the corrected value after the variation of light amount between a plurality of light spots, individual variability of the sensor, the light amount change according to the temperature change are corrected. The surface-information-detecting portion 300 sequentially determines the surface information of the fixing belt 61 according to the above detection result $R_n$. Hereinafter, the detection result $R_n$ is also referred to as reflection intensity $R_n$.

Figure 7A:
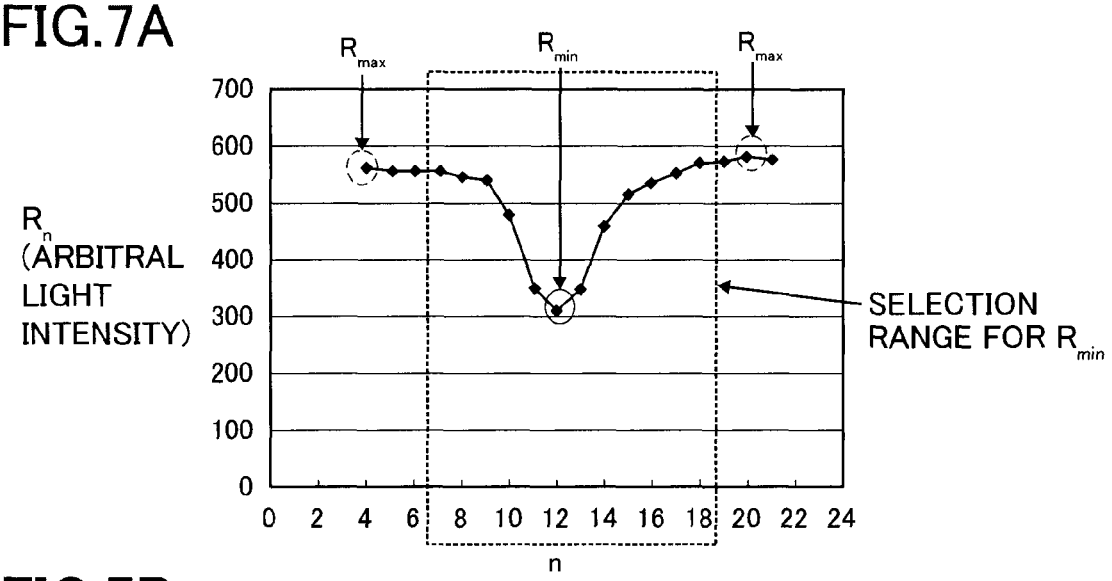
FIGS. 7A, 7B and 7C are graphs illustrating each output of a plurality of PD included in the reflective photosensor.
Figure 7B:
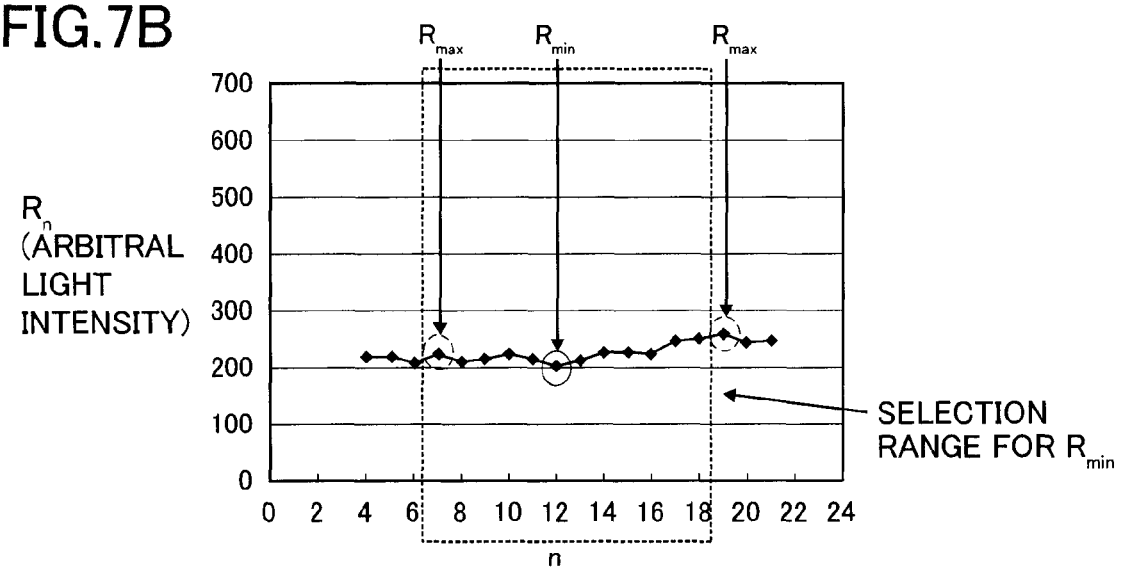
Figure 7C:
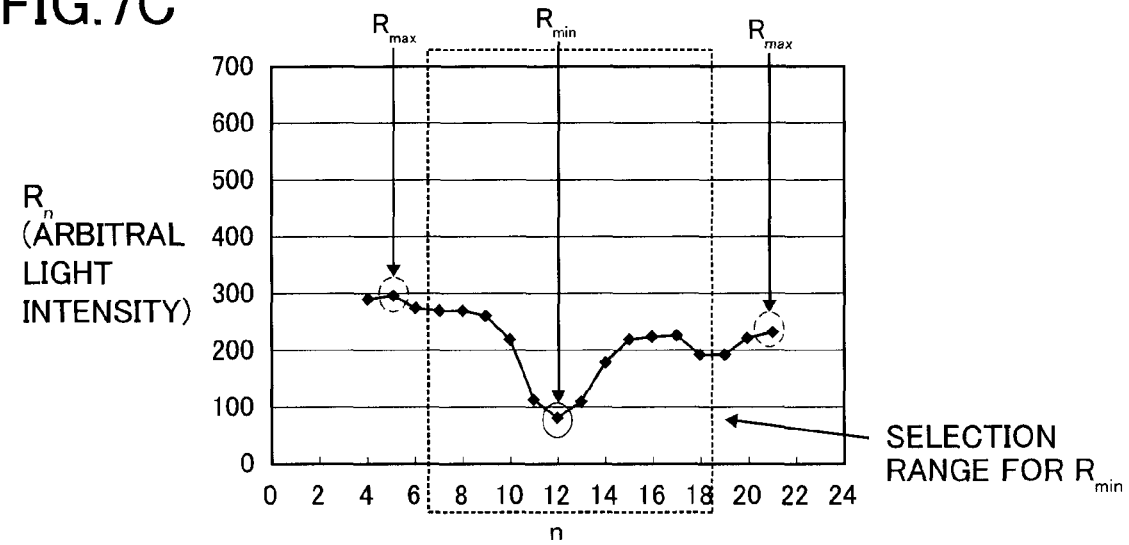

FIG. 7A to FIG. 7C illustrate a graph in which a variation in reflection intensity $R_n$ (arbitral light intensity $R_n$) generated according to an output from the reflective photosensor 200 is shown as an example. Herein, the graphs shown in FIG. 7A to FIG. 7C are generated under the condition in which each arrangement number of the LED 211 and PD 212 in the reflective photosensor 200 is N=24, and the LED to be turned on sequentially is n=4 to 21 as an example.

Herein, generally, a regularly reflected component in the reflective light from the fixing belt 61 decreases and a dispersing reflective component increases when the fixing belt 61 has a scratch on the surface thereon, compared with the case in which the fixing belt 61 does not includes the scratch. According to the above-described example, the regularly reflected component decreases on a spot on the reflection position (light spot) having a scratch so the received amount of light by the PD $\mathbf{212}_n$ decreases compared with the case without the scratch, but the received amount of light increases on the surrounding PD $\mathbf{212}_{n-m}$ to PD $\mathbf{212}_{n-1}$, PD $\mathbf{212}_{n+1}$ to PD $\mathbf{212}_{n+m}$. However, in a comprehensive manner, the value of the detection result $R_n$ according to the portion including the scratch decreases compared with that in the portion having the scratch. In accordance with such a characteristic feature of the detection signal, the surface-information-detecting portion 300 quantifies the existence and non-existence of the scratch, the level of the scratch, and the position of the scratch as the surface information. By turning on a plurality of LEDs and using the received light amount in the PD relatively with the detection, it is capable of distinguishing the decrease in the light amount received by the PD due to the decrease in the light amount of LED caused by the time degradation, the decrease in the light amount received by the PD because the fixing belt is deteriorated thoroughly (for example, there are tiny scratches on the entire fixing belt) although the linear scratch is not generated, and the decrease of the light amount received by the PD caused by the generation of the scratch.

Next, an example of a method to qualify the surface information by the surface-information-detecting portion 300 according to the detection result $R_n$ shown in FIG. 7A will be described. The surface-information-detecting portion 300 determines a range where the minimum value $R_{min}$ of the detection result $R_n$ is extracted as shown in FIG. 7A. The range where the minimum value ($R_{min}$) of the detection result $R_n$ is extracted is defined because the reflective light from the LED 211 arranged around both end side portions of the fixing belt 61 in the width direction (X-axis direction) deviates from the corresponding PD 212 when an installation error of the reflective photosensor 200 (refer to FIG. 3A) is in the direction θz (rotational direction around the rotational axis Z), thus the accuracy in the detection result $R_n$ may deteriorate. Therefore, a selection range is determined so that the accuracy of the detection result $R_n$ does not fall even though the reflective photosensor 200 includes a possible installation error in the direction θz. In the present Embodiment, the output of the PD $\mathbf{212}_4$ to PD $\mathbf{212}_6$ and PD $\mathbf{212}_{19}$ to PD $\mathbf{212}_{21}$ is not used in extraction of the minimum value $R_{min}$ as an example.

Next, the surface-information-detecting portion 300 determines the minimum value $R_{min}$ in the above-described selection range. It can be understood that the minimum value $R_{min}$ is the detection result $R_{12}$ of the PD $\mathbf{212}_{12}$ from the graph shown in FIG. 7A. That is, it is determined that the fixing belt 61 includes a linear scratch on the portion (light spot) which is irradiated by the bundle of light emitted from LED $\mathbf{211}_{12}$.

Next, the surface-information-detecting portion 300 quantifies the level of the scratch using the graph shown in FIG. 7A. Specifically, the surface-information-detecting portion 300 extracts the maximum value $R_{max}$ of the detection result $R_n$ at each area closer to one side portion and the other side portion of the fixing belt 61 in the width direction which have no scratch relative to the light spot where the minimum value $R_{min}$ (herein, detection result $R_{12}$) is obtained. That is, the surface-information-detecting portion 300 extracts the maximum value $R_{max}$ of the detection result $R_n$ on each area on the fixing apparatus 61 without any linear scratch, and calculates the average value $R_{ave}$ of each maximum value $R_{max}$ on the one side portion or the other side portion of the fixing belt 61. It can be understood that the maximum value $R_{max}$ is the detection result $R_4$ and $R_{20}$ of the PD $\mathbf{212}_4$ and PD $\mathbf{212}_{20}$ in the example shown in FIG. 7A. Then, the value ($R_{ave}$–$R_{min}$) which is the average value $R_{ave}$ minus the minimum value $R_{min}$ is obtained as the quantitative value of the linear scratch on the fixing belt 61. The surface-information-detecting portion 300 determines the existence and non-existence of the scratch by determining whether or not the above quantitative value exceeds a predetermined reference value. Herein, even though a linearly scratch is actually generated on the fixing belt 61, it will be determined as "non-existence of scratch" when the extent of the scratch can be determined such that it causes no problem with the level of the streak which comes up on the printed image due to such a linear scratch. "Existence of scratch" is determined only in the case in which the extent of the streak on the gloss surface generated due to the linear scratch has a problem.

Herein, in the present Embodiment, the predetermined reference value which is used upon determining the existence and non-existence of the scratch on the fixing belt 61 by the surface-information-detecting portion 300 varies according to the fact that the surface of the fixing belt 61 has been abraded by the surface-condition-changing roller 67 once before (in other words, it defers before or after abrasion on the fixing belt 61 by the surface-condition-changing roller 67). The reason of the above will be described hereinafter.

The above-described FIG. 7A indicates the output of the reflective photosensor 200 after performing the printing operation using the fixing belt 61 having the surface which has never been abraded by the surface-condition-changing roller 67 before. On the other hand, FIG. 7B illustrates an example of a graph showing the variation of reflective light intensity $R_n$ (arbitral light intensity $R_n$) when the fixing belt 61 is calculated using the reflective photosensor 200 after the surface of the fixing belt is abraded by the surface-condition-changing roller 67. It is clear that the quantitative value (difference between the average value $R_{ave}$ of the maximum value $R_{max}$ and the minimum value $R_{min}$) in the example as shown in FIG. 7*b* is smaller than that in the example shown in FIG. 7A. In addition, FIG. 7C illustrates an example of a variation graph of the reflective light intensity $R_n$ (arbitral light intensity $R_n$) when the reflective photosensor 200 calculates the fixing belt 61 which is used in the printing operation after the surface thereof is abraded by the surface-condition-changing roller 67. Similar to the example shown in FIG. 7A, the quantitative value (difference between average value $R_{ave}$ of the maximum value $R_{max}$ and the minimum value $R_{min}$) in the example shown in FIG. 7C is larger than that in the example shown in FIG. 7B, and it is clear that the linear scratch is generated on the portion (light spot) on the fixing belt 61 irradiated by a bundle of light from the LED $\mathbf{211}_{12}$.

Figure 8:
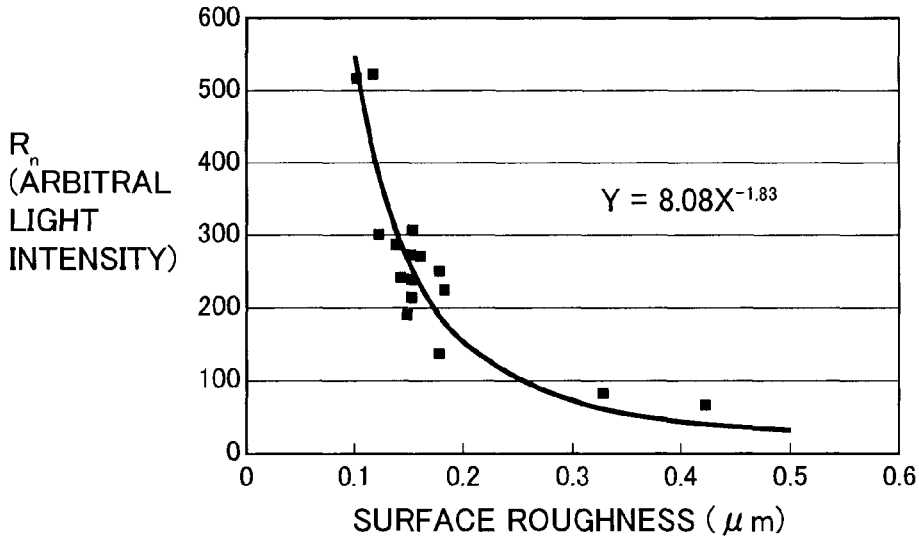
FIG. 8 is a graph illustrating a relationship between the output of the reflective photosensor and surface roughness of the fixing belt.

FIG. 8 is a graph illustrating a relationship between the detected value $R_n$ (arbitral light intensity $R_n$) obtained by the surface information detector (reflective photosensor 200) and a measured result of the surface roughness of the fixing belt 61 using a surface roughness meter. The surface roughness herein represents the average value of the surface roughness of the predetermined area on the fixing belt 61. It is clear from FIG. 8 that there is a correlative relationship between the surface roughness of the fixing belt 61 and the sensor detection value $R_n$, and such a correlation fits well with an exponent function (in the present Embodiment, supposing Y as the detected value $R_n$, and X as the surface roughness, $Y=8.08X^{-1.83}$). Thereby, the approximate surface roughness of the fixing belt 61 can be calculated from the detected value $R_n$ obtained by the reflective photosensor 200.

Even if the quantitative value obtained in relation to the fixing belt 61 which has never been abraded by the surface-condition-changing roller 67 and the quantitative value obtained in relation to the fixing belt 61 which has been abraded by the surface-condition-changing roller 67 are identical, it is clear from the graph shown in FIG. 8 (FIG. 8 shows that the detected value $R_n$ and the surface roughness are not in the proportional relationship) that there is a difference in surface roughness between the portion having the scratch (portion where the linear scratch is generated thereon) and the portion without the scratch (portion where the liner scratch is not generated thereon), which the detected value Rn and the surface roughness is not in the proportional relationship, because the detected value $R_n$ itself of the reflective photosensor 200 varies for each (generally, the value in the former case is bigger than that in the latter case as shown in FIG. 7A and FIG. 7C). Therefore, the level of the streak on the image generated due to the linear scratch varies accordingly.

In addition, when the difference in surface roughness between the scratch portion and the portion without scratch is calculated from the above-described quantitative value using the graph (including the relational expression) in FIG. 8, and when the existence and non-existence of the scratch is determined according to whether the calculated value exceeds the predetermined reference value, the level of the streak on the image generated due to the linear scratch differs even if the surface roughness on the scratch portion is similar to the portion without the scratch. The surface roughness between the scratch portion and the portion without the scratch significantly vary according to the fact that the scratch is generated on the fixing belt 61 which has never been abraded by the surface-condition-changing roller 67 or generated on the fixing belt which has been abraded by the surface-condition-changing roller 67.

Therefore, the level of the streak generated on the printed image cannot be constantly maintained if the existence and non-existence of the scratch is determined by comparing using the same reference value the quantitative value obtained by the reflective photosensor 200 in relation to the scratch on the fixing belt 61 which has never been abraded by the surface-condition-changing roller 67 and the quantitative value obtained by the reflective photosensor 200 in relation to the scratch on the fixing belt 61 which has been abraded by the surface-condition-changing roller 67. Accordingly, the reference value which is used in determining the existence and non-existence of the scratch on the fixing belt 61 is changed according to whether the fixing belt has been abraded by the surface-condition-changing roller 67 once before or not (that is, in the case of FIG. 7A and in the case of FIG. 7C) in the present Embodiment.

Figure 9:
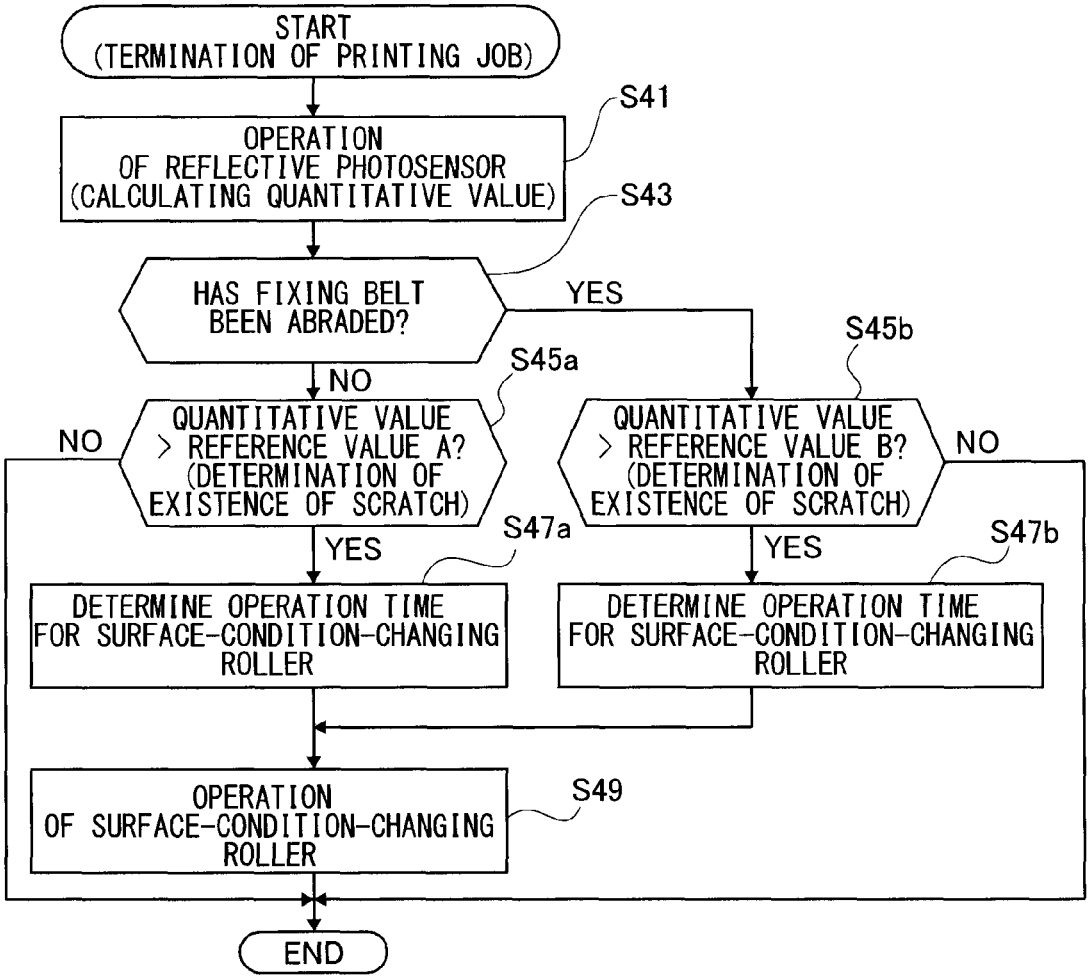
FIG. 9 is a flow chart illustrating a changing operation of the surface condition of the fixing belt.

The changing operation on the surface of the fixing belt 61 is performed according to the procedure illustrated in the flow chart shown in FIG. 9.

Figure 6:
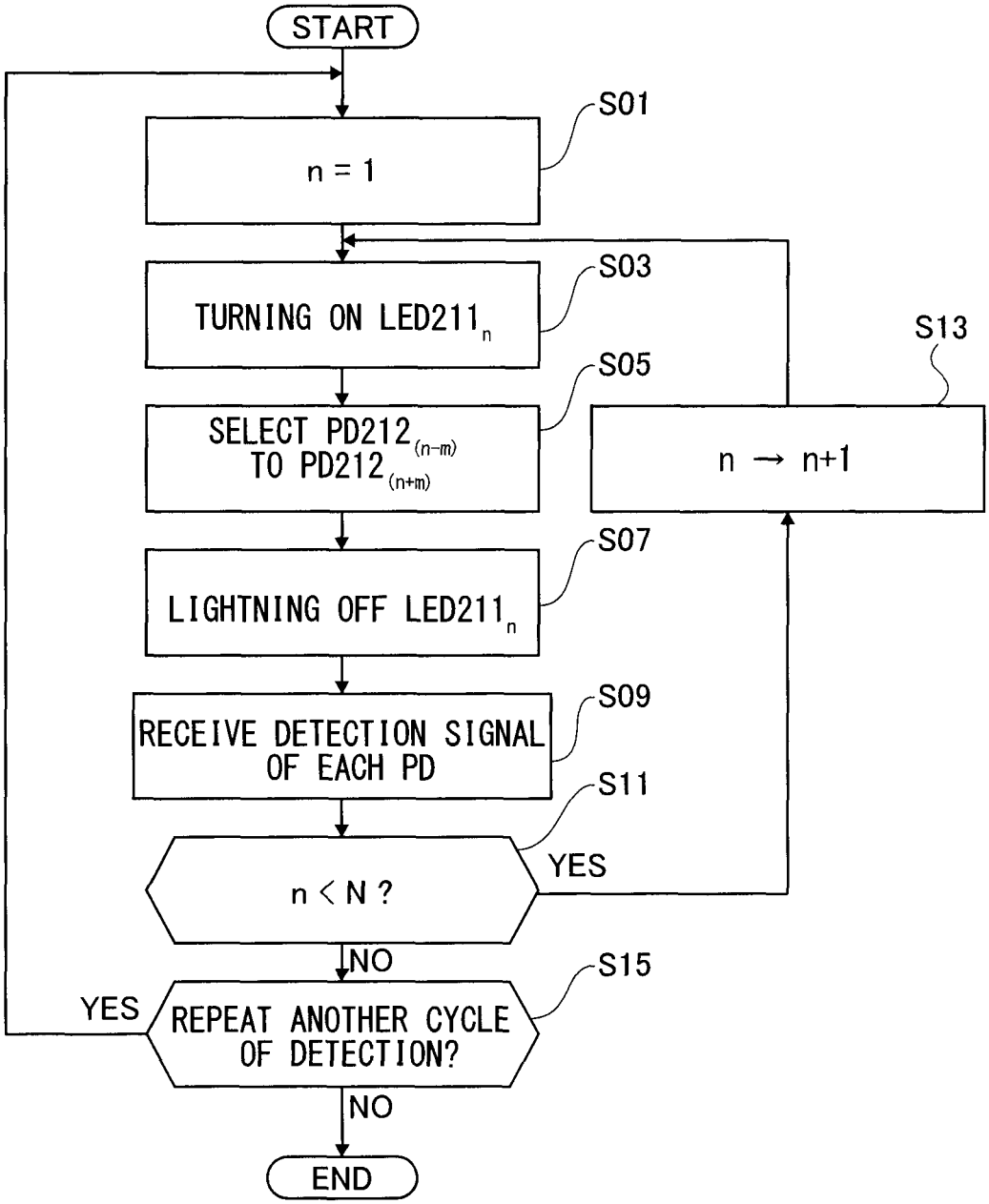
FIG. 6 is a flow chart explaining the operation of the reflective photosensor.

As shown in FIG. 9, when a printing job (a unit of a job to be executed by a computer) is terminated (image-forming process is terminated), the surface-information-detecting portion 300 gets the reflective photosensor 200 to work according to the flow chart shown in FIG. 6 under the condition that the fixing belt 61 is rotated, and calculates the above-described quantitative value in step S41. When the performance of the reflective photosensor 200 is terminated, the surface-information-detecting portion 300 determines whether the fixing belt 61 has been abraded before or not in the following step S43. The detailed method for such a determination is performed by turning on a flag upon changing the belt to a new one, and turning off the flag upon abrading the surface thereof once. Otherwise, the detected value $R_n$ of the surface-information-detecting portion 300 in relation to the portion without the scratch is used for the determination. In detail, the detection is performed according to whether the average value $R_{ave}$ of the maximum value $R_{max}$ shown in FIG. 7A to FIG. 7C exceeds a predetermined threshold or not.

When the detection result is NO in step S43, the process proceeds to step S45*a*, and when the detection result is YES in step S43, the process proceeds to step S45*b*. In step S45*a* and step S45*b*, the surface-information-detecting portion 300 determines whether the quantitative value obtained in step S41 exceeds the predetermined reference value or not. In this regard, a reference value A is used in the determination in step S45*a* and a reference value B which is different from the reference value A is used in the determination in step S45*b*.

When the quantitative values used in step S45*a* and S45*b* do not exceed (NO determination) the reference value (reference value A or reference value B in steps S45*a* and S45*b*), it is determined that a scratch which may cause a problem in relation to the printing quality is not generated on the fixing belt 61, and the surface-information-detecting portion 300 terminates the process. On the other hand, when the quantitative values exceed the reference value (reference value A or reference value B) in step S45*a* and step S45*b*, each process goes to step S47*a* and step S47*b*.

In step S47*a* and step S47*b*, the surface-information-detecting portion 300 determines the operation time of the surface-condition-changing roller 67 according to the quantitative value calculated in step S41, that is, the abutting time of the surface-condition-changing roller 67 with the fixing belt 61. The abutting time to be determined herein is required for maintaining the level of the streak generated on the printed image due to the linear scratch on the fixing belt 61 to be at a certain level or less. The relationship between the quantitative value and the abutting time varies according to whether the surface of the fixing belt 61 has been abraded at least once by the surface-condition-changing roller 67 or not. A relationship table (function or compendium) between the quantitative value regarding the fixing belt 61 which has been abraded by the surface-condition-changing roller 67 at least once and the abutting time, and a relationship table (function or compendium) between the quantitative value regarding the fixing belt 61 which has never been abraded by the surface-condition-changing roller 67 and the abutting time are preset in the present Embodiment. One of the above two tables is selected according to whether the surface of the fixing belt 61 has been abraded by the surface-condition-changing roller 67 before.

After the abutting time of the surface-condition-changing roller 67 with the fixing belt 61 is determined in step S47*a* and step S47*b*, the surface-condition-change controller 400 controls the performance of the surface-condition-changing roller 67 as follows through the detection result from the surface-information-detecting portion 300 in the following step S49.

Figure 10:
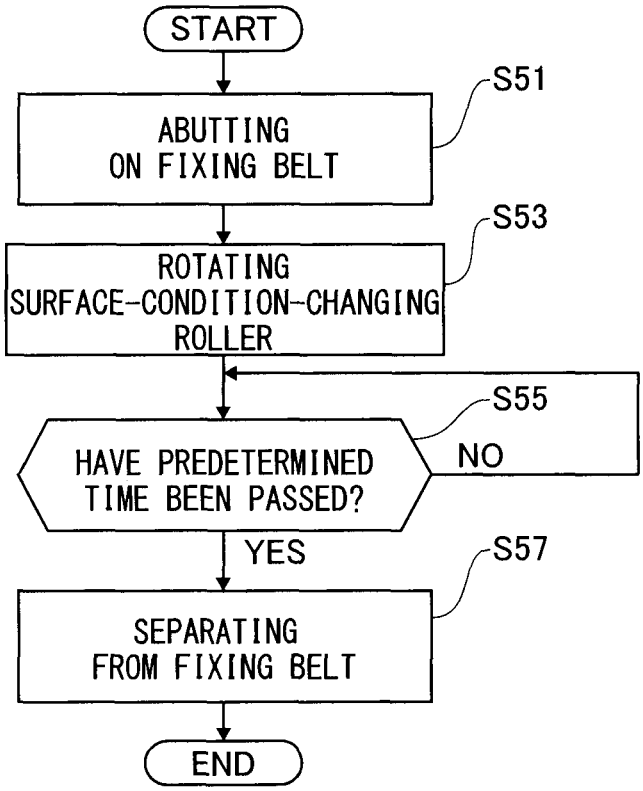
FIG. 10 is a flow chart illustrating the operation of the surface-condition-changing roller.

FIG. 10 shows a flow chart illustrating the performance of the surface-condition-changing roller 67. The surface-condition-changing roller 67 stays on a position which is apart from the fixing belt 61 during the normal operation (during a printing job, for example). Therefore, the surface-condition-change controller 400 firstly drives the surface-condition-changing roller 67 to rotate after the starting operation in step S51, and the surface-condition-change controller 400 sequentially controls the surface-condition-changing roller 67 to contact with the fixing belt 61, and the process proceeds to step S53. The fixing belt 61 is controlled so as to rotate constantly during the above operation. The surface-condition-change controller 400 controls the surface-condition-changing roller 67 to rotate during the time which is determined in step S47*a* and step S47*b* (refer to FIG. 9). It is determined in step S55 whether or not the above-described predetermined abutting time has elapsed, when the above time has elapsed, then surface-condition-changing roller 67 is separated from the fixing belt 61 in the following step S57, and the process is terminated by stopping the rotation. Thereby, because a surface layer of the surface-condition-changing roller 67 having a predetermined roughness contacts with the surface of the fixing belt 61 while the rotation, the linear scratch portion generated on the surface of the fixing belt 61 is abraded so as to expose a new surface of the fixing belt 61. That is, the surface condition of the fixing belt 61 is changed. The changing degree depends on the rotating time of the surface-condition-changing roller 67.

According to the above-described Embodiment, because the predetermined reference value which is used in the determination of the existence and non-existence of the scratch on the fixing belt 61 (fixing member) by the surface-information-detecting portion 300 is changed according to whether the surface of the fixing belt 61 has been abraded by the surface-condition-changing roller 67 once before or not (in other words, before/after abrading the fixing belt 61 by the surface-condition-changing roller 67), the variation in level of the streak caused on the transfer paper S can be reduced. Eventually, the deterioration of the image which is formed on the transfer paper S can be prevented (equalization of the printed image quality can be managed).

In addition, the abrasion time of the fixing belt 61 (fixing member) by the surface-condition-changing roller 67 varies according to whether or not the fixing belt 61 has been abraded by the surface-condition-changing roller 67 at least once before or not, so the abutting time according to the level of the scratch can be selected appropriately. Accordingly, the minimum abutting time can be determined so that the level of the streak generated on the printed image is maintained at a certain level or less, and an operating life of the fixing belt 61 can be increased.

In addition, the reflective photosensor 200 can be arranged relatively free because it includes the detection area A in the parallel direction to the width direction of the fixing belt 61. The surface information of the fixing belt 61 can be detected appropriately without influences caused by the characteristic variation or the installation variation of the reflective photosensor 200 because one reflective photosensor 200 is disposed corresponding only to the contact area W2, compared with the case in which a plurality of reflective photosensors 200 is used. In addition, the fixing belt 61 including a material having high surface hardness, such as PFA in the surface layer is easy scratched but the belt change or the like can be performed easily because the surface information thereof can be certainly detected through the reflective photosensor 200.

The reflective photosensor 200 can detect at the same time the level and the position of the linear scratch caused by the contact between the transfer paper S and the surface of the fixing belt 61. A plurality of LEDs 211 sequentially irradiates the fixing belt 61 in one direction of the width direction of the fixing belt 61 in the reflective photosensor 200. In this instance, a crosstalk (a state in which one PD 212 receives a plurality of reflective light from the LED 211 at the same time) can be prevented compared with the case in which a plurality of LEDs 211 emits light at the same time, thus the accuracy of the detection result obtained according to each position of the light spot can be improved.

Figure 11:
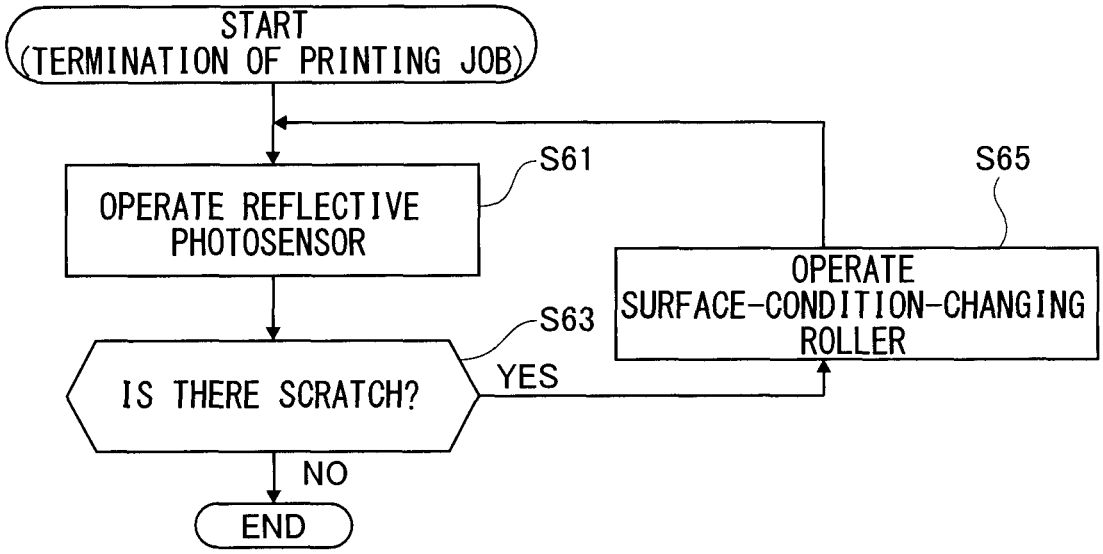
FIG. 11 is a flow chart illustrating Modified Example 1 of the changing operation of the surface condition on the fixing belt.

Herein, the configuration, controlling operation, or the like, of the apparatus described in the above Embodiment can be appropriately modified. For example, the surface-condition-change operation performed by the surface-condition-changing roller 67 can be configured according to an aspect as shown in FIG. 11. In Modified Example as shown in FIG. 11, when a printing job is terminated (image-formation process is terminated), the surface condition-detecting portion 300 drives the reflective photosensor 200 according to the flow chart as shown in FIG. 6, and obtains a quantitative value while the fixing belt 61 is rotating in step S61. When the operation of the reflective photosensor 200 terminated, the surface-information-detecting portion 300 determines the existence and non-existence of the scratch on the fixing belt 61 in the following step S63. Similar to the above-described Embodiment, the determination criteria for determining the existence and non-existence of the scratch varies according to whether the fixing belt 61 has been abraded once before (it is not described in the present Modified Example and in FIG. 11). When the detection result indicates the non-existence of the scratch (NO) as a result of the determination, the process of the surface-condition-changing control is completed without driving the surface-condition-changing roller 67. On the other hand, when the existence of the scratch is detected on the fixing belt 61 (YES) by the surface-information-detecting portion 300, the process goes to step S65, and the surface-condition-change controller 400 controls the operation of the surface-condition-changing roller 67 similar to the above-described case (refer to FIG. 10). The operation time of the surface-condition-changing roller 67 varies according to whether the fixing belt 61 has been abraded once before, similar to the above-described Embodiment (the description is omitted in the present Modified Example and in FIG. 11).

After the operation of the surface-condition-changing roller 67 in step S65 is terminated, the process returns to step S61 and the reflective photosensor 200 is operated so as to determine the surface condition of the fixing belt 61. In order to control the above operation, as shown in FIG. 1C, the surface-condition-change controller 400 is configured so as to control both of reflective photosensor 200 and surface-information-detecting portion 300. Thereby, it can be confirmed whether or not the surface condition of the fixing belt 61 is changed to have the condition without any scratch. The reflective photosensor 200 can confirm not only the position of the scratch but also confirm whether or not the uniform condition without having a scratch is obtained for all of the irradiated areas. If the scratch still remains after the confirmation, the surface-condition-changing roller 67 is operated again and a series of the operation can be repeated until the linear scratch is disappeared. Thereby, the condition of the fixing belt 61 without any scratch can be certainly obtained. The condition without the scratch herein is sufficient if the condition of the fixing belt 61 is at the extent that the influence caused by the linear scratch is acceptable degree for the image quality. For example, the condition is achieved when the linear scratch becomes small to be buried in such a tiny scratch, and the scratch is no longer recognized as the linear scratch although the entire surface of the fixing belt includes tiny scratches.

Figure 12:
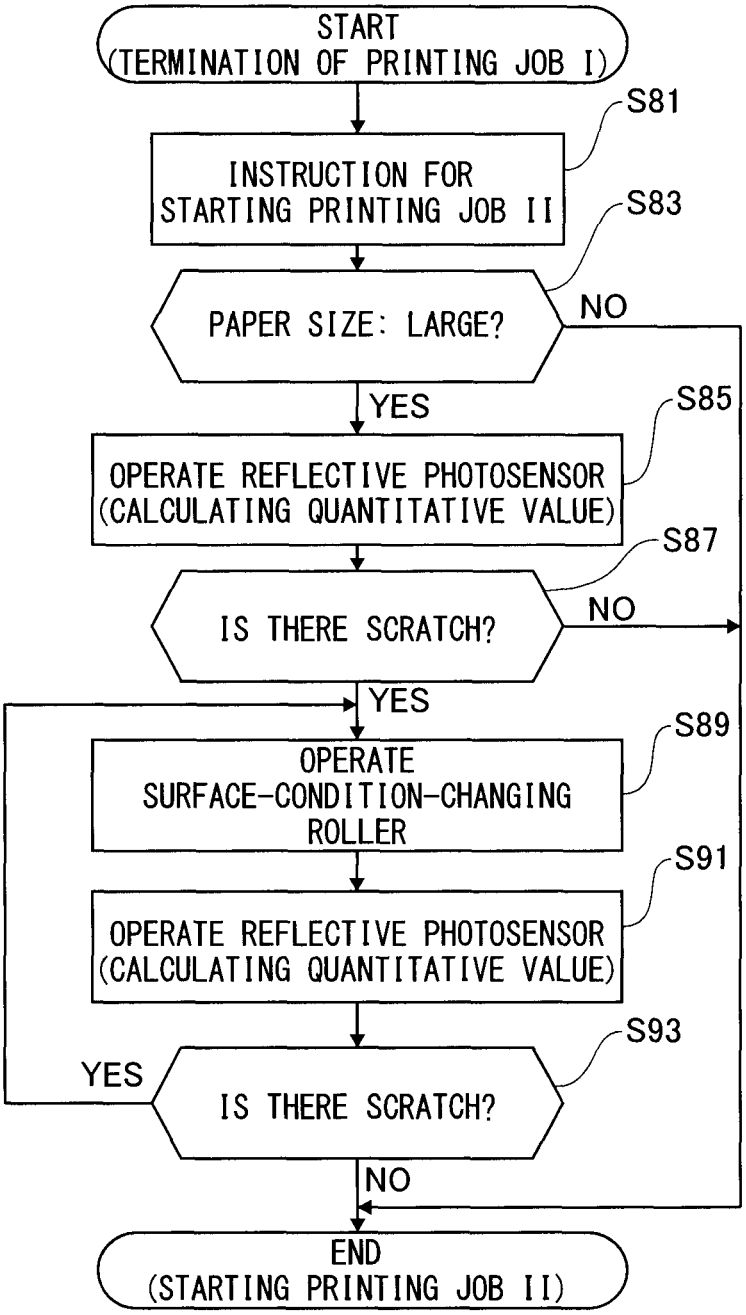
FIG. 12 is a flow chart illustrating Modified Example 2 of the changing operation of the surface condition on the fixing belt.

The surface-condition changing operation can be performed according to an aspect shown in FIG. 12. In Modified Example shown in FIG. 12, a printing operation I is performed at first, and after terminating the printing job, another printing operation II is performed using paper having a different size in the main-scanning direction from the paper which is used in the printing operation I. In the present Modified Example, when the surface-information-detecting portion 300 receives an operation instruction of the printing job II from a higher order controlling device in step S81 after the printing job of the printing operation I is terminated (process of image-forming is terminated), it is determined whether the length of the paper in the main scanning direction for use in the printing job II (paper II) is longer than the size of the paper used in the printing job I (paper I) in the following step S83. When the length of the paper II in the main-scanning direction is determined to be shorter (smaller in size) than that of the paper II in step S83, the operation is terminated without performing the surface condition-changing operation (starting the printing job II).

On the other hand, when the length of the paper II in the main-scanning direction is determined to be longer (bigger in size) than that of the paper I, the process goes to step S85, and the surface-information-detecting portion 300 drives the reflective photosensor 200 according to the flow chart shown in FIG. 6 for calculating the quantitative value. After the operation of the reflective photosensor 200 is terminated, the process goes to step S87 so that the surface-information-detecting portion 300 determines the existence and non-existence of the scratch on the fixing belt 61. Similar to the above-described Embodiment, the determination criteria of the existence and non-existence of the scratch varies according to whether the fixing belt 61 has been abraded at least once before (description is omitted in the present Modified Example and in FIG. 12).

When the existence of the scratch on the fixing belt 61 is determined in step S87, the process goes to step S89, and when the non-existence of the scratch on the fixing belt 61 is determined (actually, the influence of the scratch is at the extent that it can be considered to have no problem with the printing quality), the operation is terminated without the surface-condition-changing operation (starting the printing job II). In step S89, the surface-information-detecting portion 300 drives the surface-condition-changing roller 67 so as to abrade the surface of the fixing belt 61. The time for abrading the surface of the fixing belt 61 in this instance varies according to whether the fixing belt 61 has been abraded once before (description is omitted in the present Modified Example and FIG. 12). Next, the reflective photosensor 200 is driven again in step S91, and it is determined whether the linear scratch that may cause a problem with the printing quality is generated on the fixing belt 61 or not according to the result in step S91 in step S93. The reference value which is used in step S93 for determining the existence and non-existence of the scratch is one value because it is obvious that the fixing belt 61 has been abraded before (in step S89). When the existence of the scratch on the fixing belt 61 is determined in step S93 (the scratch is not resolved during step S89 despite the performance of the surface-condition-changing roller 67), the process goes back to step S89 and the surface-condition-changing roller 67 is driven again. On the other hand, when the non-existence of the scratch on the fixing belt 61 is determined, the operation is terminated (starting the printing job II).

The surface-condition-changing operation on the fixing belt 61 by the surface-condition-changing roller 67 is not performed when the size of the paper which is used in the printing job II is smaller than that of the paper used in the printing job I (NO determination in step S83) in the above-described Modified Example according the flow chart shown in FIG. 12. This is because the linear scratch formed on the fixing belt 61 when the printing is operated using paper having a large size (broad width) may not cause a problem upon a printing operation using smaller size (narrow width) paper. Because the need to perform the surface-condition-changing operation for the fixing belt 61 is determined according to the size of the printing paper in the present Modified Example, the efficiency is better than that in the case in which the reflective photosensor 200 is always driven so as to determine the existence or non-existence of the scratch.

Figure 13A:
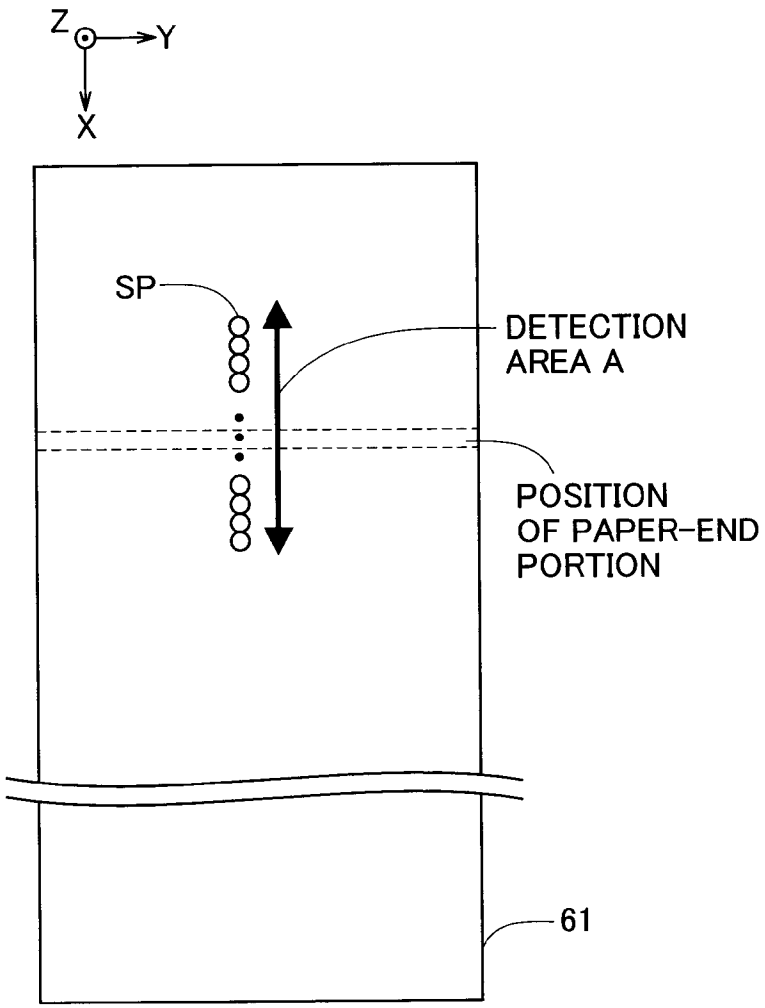
FIG. 13A illustrates an arrangement of a plurality of PD included in the reflective photosensor in Embodiment.
Figure 13B:
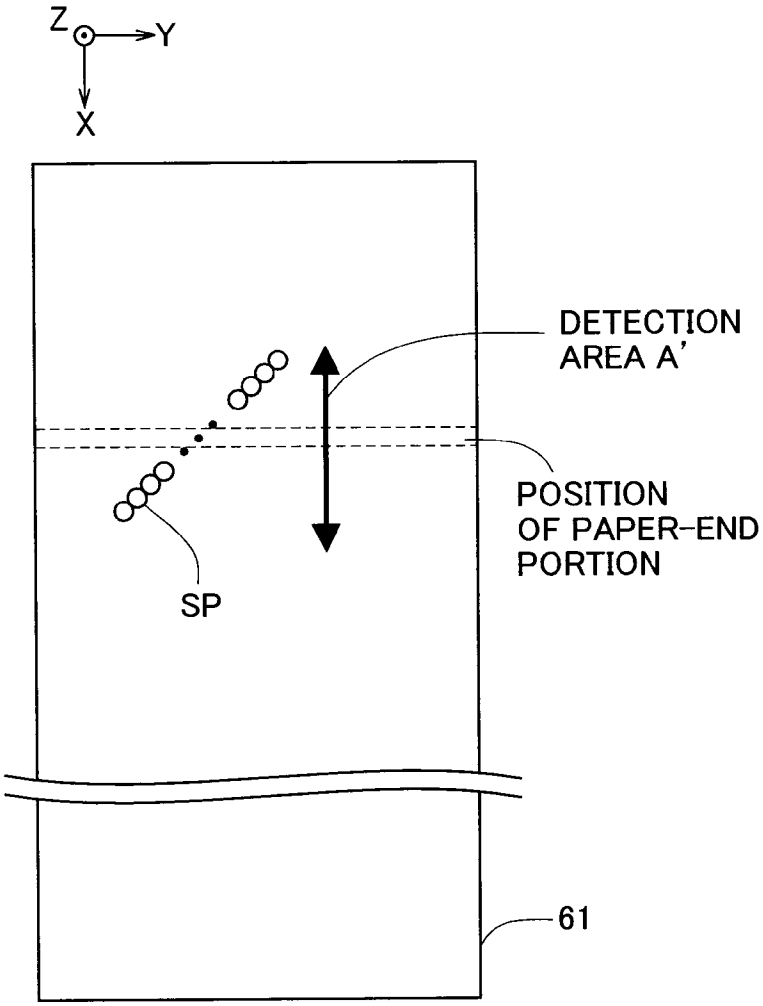
FIG. 13B illustrates Modified Example of an arrangement of the plurality of PD included in the reflective photosensor.

In addition, as shown in FIG. 13A, a plurality of light spots SP (detection position of the reflective photosensor 200) is arranged on the fixing belt 61 along the parallel direction to the width direction of the fixing belt 61 (X-axis direction) in the above-described Embodiment. However, the configuration is not always limited to the above and it is acceptable if the light spots SP are arranged to cross the X-axis direction at 45 degrees as shown in FIG. 13B, for example. The length of the detection area A' in the X-axis direction is shorter to be in $1/\sqrt{2}$ compared with the detection area A (refer to FIG. 13A) but the arrangement interval of the light spots adjacent to each other can be reduced to be $1/\sqrt{2}$. Therefore, the position resolution of the detection result can be improved.

Figure 14:
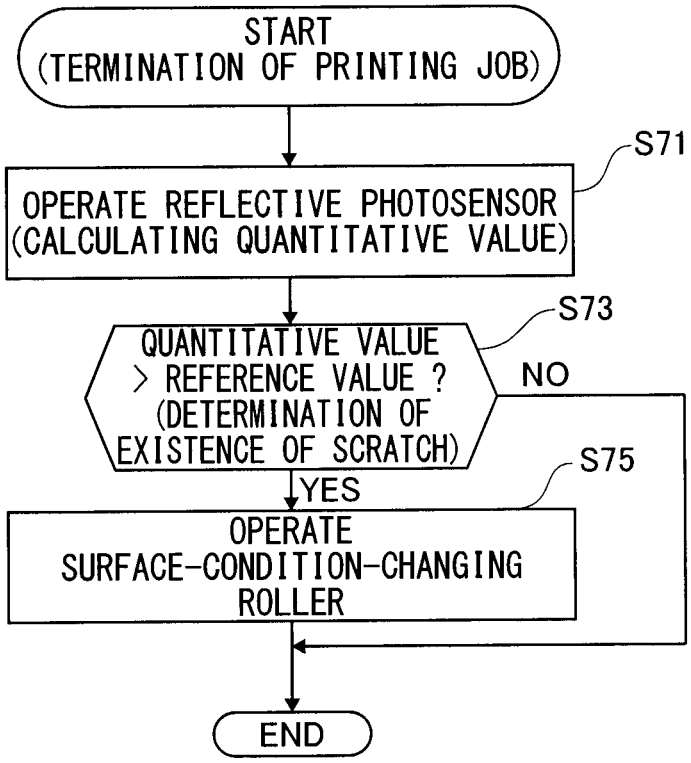
FIG. 14 is a flow chart illustrating the changing operation of the surface condition on the fixing belt according to the Modified Example.

The detection as to whether the fixing belt 61 has been abraded at least once before is performed and the control operation to select two different reference values according to the detection result is performed in the above-described Embodiment. However, the configuration is not always limited to the above, and for example, it can be configured so as to abrade the surface of the fixing belt 61 after the fixing belt 61 is changed to a new one and the surface-condition-changing roller 67 is driven prior to the printing operation. In this instance, as shown in a flow chart in FIG. 14, when the printing job is terminated (start), the surface-information-detecting portion 300 calculates the above-described quantitative value at the same time as it drives the reflective photosensor 200 according to the flow chart shown in FIG. 6 under the condition in which the fixing belt 61 rotates in step S71. Step S43 (refer to FIG. 9) in the above-described Embodiment is not necessary because it is certain that the fixing belt 61 has been abraded in the present Modified Example.

Next, the surface-information-detecting portion 300 determines whether or not the quantitative value obtained in step S71 exceeds the predetermined reference value in step S73. The reference value used herein is a single reference value, which is different to that in the above-described Embodiment. Sequentially, similar to the above-described Embodiment, the process goes to step S75 in which the surface-condition-changing roller 67 is driven so as to abrade the surface of the fixing belt 61 when the quantitative value exceeds the reference value. It is appropriate to change the driving time of the surface-condition-changing roller 67 during the above operation, similar to the above-described Embodiment, according to the level of the scratch with reference to the relationship table (function or list) which is prepared in advance. When the quantitative value does not exceed the reference value, the operation is terminated. According to the present Modified Example, the level of the streak on the printed image can be suppressed to a certain extent.

In addition, the fixing belt 61 can be abraded by the surface-condition-changing roller 67 without any influence from the linear scratch as a detection object when the surface of the fixing belt 61 is previously abraded by operating the surface-condition-changing roller 67 prior to the printing operation and after the fixing belt 61 is changed to a new one as described above. The output value of the reflective photosensor 200 herein is stored in a recording medium so that it can be used as criteria for determining the disappearance of the linear scratch in the process for detecting the linear scratch and abrading the detected scratch by the surface-condition-changing roller.

In addition, the surface-information-detecting portion 300 is configured to calculate a sum of the detection signal by the calculation every time as the surface-information-detecting portion 300 receives the detection result from a plurality of PDs 212 in the above-described Embodiment. However, the configuration is not always limited to the above. For example, it is also appropriate to configure a plurality of PD 212 to receive the reflective light corresponding to the timing of concurrent emission of the LED 211 because a plurality of LEDs 211 provided with the reflective photosensor 200 can emit light at one time. In this instance, it is also appropriate to configure the surface-information-detecting portion 300 not to calculate the sum of the detection signal but to obtain the reflective light intensity $R_n$ in relation to the plurality of positions on the surface of the fixing belt 61 having intervals for each in the width direction using the detection result $R_n$ through each PD $\mathbf{212}_n$ which corresponds to each LED $\mathbf{211}_n$.

In addition, the above-described Embodiment represents the case in which the surface information in relation to the linear scratch on the fixing belt 61 is the main object of detection but the detected result is not always limited to the above. The scratch which is made because of the offset as described above, thermistor, and/or contact with a peeling claw may be the detection object. For example, the deterioration in reflective light intensity $R_n$ of the detected result is relatively low and is caused in a broad range in the offset case when the toner adhered on the surface of the fixing belt 61 has a film-like condition. The detection can be managed according to such a characteristic feature of the scratch in the offset. In addition, contrary to the fact that the width of the linear scratch is from about several hundreds of μm to about several mm, the scratch due to the thermistor or contact with the peeling claw is from about several tens of μm to about several hundreds of μm. Since the generating point of the scratch may be approximately fixed, such a scratch can be distinguished with the linear scratch through the detected position and the width of the scratch.

In addition, in the above-described Embodiment, the fixing belt 61 is used as the fixing member; however, the fixing member is not always limited to the above, and a fixing roller can be used instead.

In addition, in the above-described Embodiment, the surface-condition-changing roller 67 performs the abutting, separating, and sliding operation on the portion where the fixing belt 61 does not make contact with the fixing roller 64. However, such an operation can be performed on the contacting portion between the fixing belt 61 and the fixing roller 64.

In addition, the configuration of the reflective type optical detection device is not limited to the reflective photosensor 200 in the above-described Embodiment. It is also appropriate to configure the reflective type optical detection device so as to emit a plurality of light in the width direction of the fixing belt 61 and to receive the reflective light thereof. For example, the reflective photo sensor 200 includes a plurality of LEDs 211 and a plurality of PDs 211 which are arranged in an array so as to face each other one by one; however, it is not necessarily limited to the above configuration. The light deflection type arrangement in which the laser beam is polarized by a light deflector and one or more PDs receive the reflective light from the surface of the fixing belt can be used. Furthermore, a sensor-driving type reflective photosensor in which a light sensor configured by a single LED and single PD is moved in the width direction of the fixing belt 61 by a driver is also appropriate.

In addition, the configuration of the reflective photosensor 200 is not always limited to the above-described Embodiment. For example, it can be configured so as to include N (≥1) of LED 211 arranged in one direction, M (N≥M≥1) of lens which collects a light beam emitted from each of N LED 211 on the surface of the fixing belt 61 so as to configure the light spot, and K (N≥K≥1) of a photosensor which receives reflective light from the fixing belt 61 so as to form a light spot. In this case, a configuration of the condenser lens array can be simplified because one condenser lens is assigned for a plurality of LEDs 211. In such a case, a photosensor which has a single light-receiving surface can be used. A condenser lens can also be used as a light-receiving lens in the photosensor if it is configured to be large in size.

In addition, in a transfer system in the color printer 100 in the above-described Embodiment, color toner image generated on each photosensitive drum 20Y to 30B is primarily transferred on the transfer belt 11 by the sequential superimposition, and the transferred color-toner image is transferred on the transfer paper S all at once by the secondary transfer roller 17. However the transfer system is not always limited to the above. For example, it is appropriate that the system be such that the transfer paper S is held and sent on the transfer belt 11 so that the transfer paper S faces and makes contact with each photoconductor drum, and the toner image of each color is directly transferred onto the transfer paper S by the sequential superimposition from each photoconductor drum. In this case, the fixing operation of the color toner image in the above instance can be performed similar to the above-described Embodiment.

When the color printer 100 is configured so as to print several sizes of paper, such as A3, A4, A5, or the like, the maximum size of the paper capable of passing through the color printer 100 is A3. In most cases, the A3 paper is sent in the long side direction thereof. In this instance, the detection is performed on the surface information regarding the linear scratch on the transfer paper in all sizes except the A3-size. When it is supposed that A2 paper is capable of being sent through the color printer 100 in the long side direction, the detection is performed on the surface information regarding the linear scratch due to the transfer paper in all sizes except A2. In the description, if the A4 paper, for example, is sent in the long side direction, the width of the paper differs from the case in which the paper is sent in the short side direction even though it has the same A4 size. In such a case, it is determined that a plurality of sheet-like recording media each having a different size is sent.

According to the present invention, variations in image quality of a toner image which is fixed onto the sheet-like recording medium can be reduced.

The image-forming apparatus is a color printer in the above-described Embodiment, but the image-forming apparatus is not always limited to a color printer. For example, a monochrome copier, color copier, facsimile device, plotter device, or the like can be used, or a so-called MFP (Multi-Function Printer) can be also used.

Although the embodiments of the present invention have been described above, the present invention is not limited thereto. It should be appreciated that variations may be made in the embodiments described by persons skilled in the art without departing from the scope of the present invention.

What is claimed is:

1. A fixing apparatus for fixing a toner image borne on a sheet-like recording medium onto the sheet-like recording medium, comprising:

a fixing device relatively moving in a first direction with respect to the sheet-like recording medium, and having a surface in contact with the toner image during a fixing operation;

a photosensor configured to obtain surface information of the fixing device;

a surface-condition-changing roller arranged to abut on and separate from the fixing device, and abrading the surface of the fixing device in contact with the fixing device; and a processing circuit configured to control an abutting and separating of the surface-condition-changing roller with respect to the fixing device according to a detection result of the photosensor, wherein the processing circuit controls the surface-condition-changing roller according to the detection result of the photosensor with a criteria which varies before and after the surface-condition-changing roller abrades the fixing device.

2. The fixing apparatus according to claim 1, wherein the surface information of the fixing device obtained by the photosensor is in relation to a depth of a linear scratch generated on the surface of the fixing device.

3. The fixing apparatus according to claim 1, wherein the processing circuit controls an abutting time of the surface-condition-changing roller with the fixing device according to the surface information detected by the photosensor, and the abutting time, which is determined according to the surface information, varies depending on whether the detection of the surface information by the photosensor is operated to the fixing device including the surface which is abraded at least once by the surface-condition-changing roller.

4. The fixing apparatus according to claim 1, wherein the fixing device performs the fixing operation on the sheet-like recording medium of a plurality of sizes each having a different length in a second direction which is orthogonal to the first direction for each, and the processing circuit controls the surface-condition-changing roller to abrade the surface of the fixing device when the size of the sheet-like recording medium is changed to a larger size.

5. The fixing apparatus according to claim 1, wherein the surface-condition-changing roller abrades an entire contact area of the sheet-like recording medium and the fixing device in relation to a second direction, which is orthogonal to the first direction on the surface of the fixing device.

6. The fixing apparatus according to claim 1, wherein the photosensor includes a reflective type optical device to irradiate the fixing device with a plurality of detection lights in a direction crossing the first direction, and to calculate the surface information of the fixing device according to reflection light of the detection light.

7. An image-forming apparatus comprising:

a developing device forming one or more toner images by an electrophotographic process;

a transfer device for transferring the toner image onto the sheet-like recording medium; and the fixing apparatus according to claim 1 for fixing the toner image borne on the sheet-like recording medium to the sheet-like recording medium.

8. A fixing apparatus for fixing a toner image borne on a sheet-like recording medium, comprising:

a fixing device relatively moving in a first direction with respect to the sheet-like recording medium, and including a surface in contact with the toner image during a fixing operation;

a photosensor configured to obtain surface information of the fixing device;

a surface-condition-changing roller arranged to abut on and separate from the fixing device, and abrading the surface of the fixing device in contact with the fixing device; and a processing circuit configured to control the abutting and separating of the surface-condition-changing roller with respect to the fixing device according to a detection result of the photosensor, wherein after the surface-condition-changing roller abrades the fixing device at least once, the processing circuit controls the surface-condition-changing roller according to the detection result of the photosensor with a criteria in accordance with the detection result of the photosensor obtained after the surface-condition-changing roller abrades the fixing device.

9. The fixing apparatus according to claim 8, wherein the surface information of the fixing device obtained by the photosensor is in relation to a depth of a linear scratch generated on the surface of the fixing device.

* * * * *